US011092157B2

(12) United States Patent
Duppert et al.

(10) Patent No.: US 11,092,157 B2
(45) Date of Patent: Aug. 17, 2021

(54) PRESS-FIT BEARING HOUSING WITH NON-CYLINDRICAL DIAMETER

(71) Applicants: Ronald J. Duppert, Fayetteville, NY (US); Xianghong Wang, York, PA (US)

(72) Inventors: Ronald J. Duppert, Fayetteville, NY (US); Xianghong Wang, York, PA (US)

(73) Assignee: BITZER Kühlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 15/238,397

(22) Filed: Aug. 16, 2016

(65) Prior Publication Data

US 2016/0356274 A1 Dec. 8, 2016

Related U.S. Application Data

(62) Division of application No. 13/428,337, filed on Mar. 23, 2012, now Pat. No. 9,458,850.

(51) Int. Cl.
*F04C 29/00* (2006.01)
*F04C 18/02* (2006.01)
(Continued)

(52) U.S. Cl.
CPC ..... *F04C 29/005* (2013.01); *F04C 18/023* (2013.01); *F04C 18/0215* (2013.01);
(Continued)

(58) Field of Classification Search
CPC .. F01C 21/007; F04C 18/0215; F04C 18/023; F04C 23/008; F04C 29/023;
(Continued)

(56) References Cited

U.S. PATENT DOCUMENTS 4,376,333 A * 3/1983 Kanamaru ..... B21K 25/00 29/432
4,877,382 A * 10/1989 Caillat ..... F01C 1/0215 418/55.5
(Continued)

FOREIGN PATENT DOCUMENTS

EP 0584466 A2 3/1994
EP 1066900 A2 1/2001
(Continued)

*Primary Examiner* — Patrick Hamo
*Assistant Examiner* — Joseph S. Herrmann
(74) *Attorney, Agent, or Firm* — Reinhart Boerner Van Deuren P.C.

(57) ABSTRACT

A scroll compressor that includes a housing and scroll compressor bodies disposed in the housing. A motor is disposed within the housing and operably connected to a drive shaft for driving one of the scroll compressor bodies. The drive shaft is rotationally supported at one end by a crankcase which includes a bearing housing and a bearing. The crankcase includes a plurality of openings or gas passages passing through the crankcase, as well as a plurality of generally cylindrical sections positioned respectively between adjacent openings. The cylindrical sections define contact regions which can engage an inner periphery of the housing when the crankcase is mounted therein.

17 Claims, 20 Drawing Sheets

(51) Int. Cl.
*F04C 23/00* (2006.01)
*F01C 21/00* (2006.01)

(52) U.S. Cl.
CPC ..... *F04C 23/008* (2013.01); *F04C 29/0085* (2013.01); *F01C 21/007* (2013.01); *F04C 2230/60* (2013.01); *F04C 2230/603* (2013.01); *F04C 2240/30* (2013.01); *F04C 2240/40* (2013.01); *F04C 2240/50* (2013.01); *F04C 2240/56* (2013.01); *F04C 2240/60* (2013.01); *F04C 2240/805* (2013.01)

(58) Field of Classification Search
CPC ..... F04C 29/005; F04C 29/0085; F04C 2230/60; F04C 2230/603; F04C 2240/30; F04C 2240/50; F04C 2240/54; F04C 2240/56; F04C 2240/805; F04C 2240/40; F04C 2240/60
USPC ..... 417/410.5; 418/55.1–55.6, 57, 94; 29/888.022, 898.07, 525
See application file for complete search history.

(56) References Cited

U.S. PATENT DOCUMENTS 5,042,150 A 8/1991 Fraser, Jr.
5,102,316 A * 4/1992 Caillat ..... F01C 1/0215 418/55.5
5,306,126 A 4/1994 Richardson, Jr.
5,342,185 A 8/1994 Anderson
5,407,335 A 4/1995 Caillat et al.
5,427,511 A 6/1995 Caillat et al.
5,482,450 A 1/1996 Caillat et al.
RE35,216 E 4/1996 Anderson et al.
5,522,715 A 6/1996 Watanabe et al.
5,580,230 A 12/1996 Keifer et al.
5,846,065 A 12/1998 Sano et al.
5,897,306 A 4/1999 Beck
6,289,776 B1 * 9/2001 Altstadt ..... B23B 31/12 279/110
6,293,767 B1 9/2001 Bass
6,398,530 B1 6/2002 Hasemann
6,544,017 B1 4/2003 Skinner
6,560,868 B2 5/2003 Milliff et al.
6,579,012 B2 * 6/2003 Brandenstein ..... B23P 15/003 29/451
6,648,616 B2 11/2003 Patel et al.
6,709,247 B1 * 3/2004 Clendenin ..... F04C 23/008 384/215
6,761,541 B1 6/2004 Clendenin
6,799,956 B1 10/2004 Yap et al.
6,814,551 B2 11/2004 Kammhoff et al.
6,960,070 B2 11/2005 Kammhoff et al.
7,070,401 B2 7/2006 Clendenin et al.
7,112,046 B2 9/2006 Kammhoff et al.
7,168,931 B2 1/2007 Ginies
7,819,638 B2 10/2010 Grimm et al.
7,878,775 B2 2/2011 Duppert
7,914,268 B2 3/2011 Su
8,002,528 B2 8/2011 Hodapp et al.
8,133,043 B2 3/2012 Duppert
8,152,500 B2 4/2012 Beagle et al.
8,167,595 B2 5/2012 Duppert
8,167,596 B2 5/2012 Kishikawa et al.
8,876,496 B2 11/2014 Rogalski
8,920,139 B2 12/2014 Roof et al.
9,011,105 B2 4/2015 Duppert et al.
9,022,758 B2 5/2015 Roof et al.
9,039,384 B2 5/2015 Duppert et al.
9,057,269 B2 6/2015 Bush
9,080,446 B2 7/2015 Heusler
9,181,940 B2 11/2015 Cullen et al.
9,441,631 B2 9/2016 Roof
9,458,850 B2 10/2016 Duppert et al.
2004/0057859 A1 3/2004 Haller
2004/0208768 A1 10/2004 Yap et al.
2007/0092173 A1 * 4/2007 Tsuji ..... F16C 17/02 384/276
2007/0107188 A1 5/2007 Jee et al.
2009/0035168 A1 2/2009 Ginies
2009/0068044 A1 3/2009 Guo et al.
2009/0252624 A1 10/2009 Genevois et al.
2010/0021330 A1 1/2010 Haller
2010/0254842 A1 10/2010 Wilson
2013/0251551 A1 9/2013 Bessel et al.
2013/0251567 A1 9/2013 Wang et al.
2013/0251569 A1 9/2013 Duppert
2013/0251577 A1 9/2013 Bush et al.

FOREIGN PATENT DOCUMENTS

EP 1122437 A2 8/2001
KR 20100068397 A 6/2010

* cited by examiner

PRESS-FIT BEARING HOUSING WITH NON-CYLINDRICAL DIAMETER

CROSS-REFERENCE TO RELATED PATENT APPLICATIONS

This patent application is a divisional of co-pending U.S. patent application Ser. No. 13/428,337, filed Mar. 23, 2012, the entire teachings and disclosure of which are incorporated herein by reference thereto.

FIELD OF THE INVENTION

The present invention generally relates to scroll compressors for compressing refrigerant and more particularly to an apparatus for controlling and/or limiting at least one of relative axial, radial, and rotational movement between scroll members during operation of the scroll compressor.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

In some scroll compressors, it is known to have axial restraint, whereby the fixed scroll member has a limited range of movement. This can be desirable due to thermal expansion when the temperature of the orbiting scroll and fixed scroll increases causing these components to expand. Examples of an apparatus to control such restraint are shown in U.S. Pat. No. 5,407,335, issued to Caillat et al., the entire disclosure of which is hereby incorporated by reference.

Further, many conventional scroll compressors are designed such that gaseous refrigerant will enter the compressor, flow over the electric motor therein, through passages of a bearing housing referred to in the industry as a "crankcase", to ultimately enter the compressor members for compression. The crankcase is typically press fit in the housing. The passages in the crankcase are positioned at an outer periphery of the crankcase such that the crankcase is in intermittent contact with the housing.

In such a conventional configuration, the electrical contacts and other temperature sensors are often times positioned within the passages for space conservation purposes. These contacts and sensors are coupled to their appropriate connector counterparts such that the connection thereof extends through a sidewall of the housing. At the region of these connections, a terminal box or other housing encloses the same on the exterior of the housing. One example of the electrical contacts and their associated housing can be seen at U.S. Pat. No. 6,350,111, the disclosure of which is incorporated by reference thereto in its entirety.

However, the aforementioned passages are typically equally spaced about the circumference of the crankcase, and are relatively small. As a result, only a single item, e.g., an electrical contact or sensor, can be located in each passage. As such, multiple terminal box enclosures are required on an exterior of the housing to protect each connection point. Alternatively, a very large terminal box that captures several connection points is sometimes used. In either case, the cost of the scroll compressor increases, and its aesthetic appearance is diminished.

The present invention is directed towards improvements over the state of the art as it relates to the above-described features and other features of scroll compressors.

BRIEF SUMMARY OF THE INVENTION

In one aspect, embodiments of the present invention provide a scroll compressor. The scroll compressor includes a housing, scroll compressor bodies, an electrical motor, a drive shaft, and a bearing member. The scroll compressor bodies have respective bases and respective scroll ribs that project from the respective bases and which mutually engage for compressing fluid. The electrical motor has a stator and a rotor. The drive shaft is for rotation about an axis. The rotor of the electrical motor acts upon the drive shaft that in turn acts upon the scroll compressor bodies to facilitate relative orbiting movement between the scroll compressor bodies. The bearing member is adapted to retain the drive shaft. The bearing member includes at least two cylinder sections. The at least two cylinder sections may be angularly spaced apart and separated by at least two corresponding gaps.

In another aspect, the housing comprises a cylindrical shell section. The bearing member is press fitted into the cylindrical shell section. The cylindrical shell section defining a smaller inner radius at the at least two corresponding gaps than an outer radius defined by the at least two cylinder sections, relative to the axis.

In another aspect, the bearing member is an upper bearing member situated generally above the electrical motor. The upper bearing member comprises a plurality of posts projecting upwardly for supporting directly or indirectly one of the scroll compressor bodies. Wherein each cylinder section connects at least two adjacent posts with each gap generally separating two adjacent posts.

In yet another aspect, each post is connected to a pilot ring. The pilot ring slidably contacts and pilots one of the scroll compressor bodies.

In another aspect, the pilot ring is a separate member from the bearing member. A plurality of bolts, one for each post, connects the pilot ring to the bearing member.

In yet another aspect, two cylinder sections are provided on opposite sides of the axis, and two gaps are provided on opposite sides of the axis extending between the two cylinder sections on the opposite sides, respectively.

In some implementations, each cylinder section spans greater than 50 degrees and less than 150 degrees.

In certain embodiments, the cylinder sections are symmetrical.

In another aspect, each cylinder section comprises an outer cylindrical surface spanning greater than 50 degrees and less than 150 degrees. Each cylinder section further comprises at least one lubrication drainage channel formed in each cylinder section and extending vertically over the cylindrical surface from top to bottom so as to facilitate drainage.

In yet another aspect, each cylinder section comprises a contact region including a first section with a first radius of curvature, a second section extending from the first section wherein the second section is flat, and a third section extending from the second section and having a second radius of curvature.

In another aspect, embodiments of the present invention provide a scroll compressor. The scroll compressor includes a housing, scroll compressor bodies, an electrical motor, a drive shaft, a bearing member, and a pilot. The housing comprises a cylindrical shell section arranged about an axis that is vertically extending. The scroll compressor bodies are in the housing and have respective bases and respective scroll ribs that project from the respective bases and which mutually engage for compressing fluid. The electrical motor has a stator and a rotor. The drive shaft is for rotation, and the rotor acts upon the drive shaft that in turn acts upon the scroll compressor bodies to facilitate relative orbiting movement between the scroll compressor bodies. The bearing member supports the drive shaft for rotation, and the bearing member is press fit into the cylindrical shell section. The pilot is connected to the bearing member, and the pilot slidably contacts and pilots one of the scroll compressor bodies for axial movement relative to the bearing member.

In another aspect the pilot is a pilot ring surrounding at least one of the scroll compressor bodies with a cylindrical pilot interface therebetween.

In yet another aspect, the bearing comprises at least two cylinder sections. The at least two cylinder section may be angularly spaced apart and separated by at least two corresponding gaps. The cylindrical shell section defines a smaller inner radius at the at least two corresponding gaps than an outer radius defined by the at least two cylinder sections, relative to the axis.

In a certain embodiment, the bearing member is an upper bearing member situated generally above the electrical motor. The upper bearing member connects to the pilot by a plurality of posts projecting upwardly. Each cylinder section connects at least two adjacent posts, and each gap generally separates two adjacent posts.

In yet another aspect, the bearing comprises at least two cylinder sections. Wherein each cylinder section comprises an outer cylindrical surface spanning greater than 50 degrees and less than 150 degrees. And the cylinder section further comprises at least one lubrication drainage channel formed in each cylinder section and extending vertically over the cylindrical surface from top to bottom so as to facilitate drainage.

In another aspect, the bearing comprises at least two cylinder sections. Wherein each cylinder section comprises a contact region including a first section with a first radius of curvature, a second section extending from the first section wherein the second section is flat, and a third section extending from the second section and having a second radius of curvature.

Another aspect of the invention is directed toward manufacturing and assembly features. A method of providing for a scroll compressor comprises compressing fluid with a pair of scroll compressor bodies. The method then drives the scroll compressor bodies relative to each other with an electrical motor. The electrical motor has a stator and a rotor providing rotational output on a drive shaft. The drive shaft may be adapted to act on one of the scroll compressor bodies. The method further includes press fitting a bearing member into a compressor housing. The method then rotationally supports the drive shaft with the bearing member for rotation about an axis. The method then pilots one of the scroll compressor bodies for a limited range of axial movement relative to the bearing member with a pilot. The method then connects the pilot to the bearing member for support.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
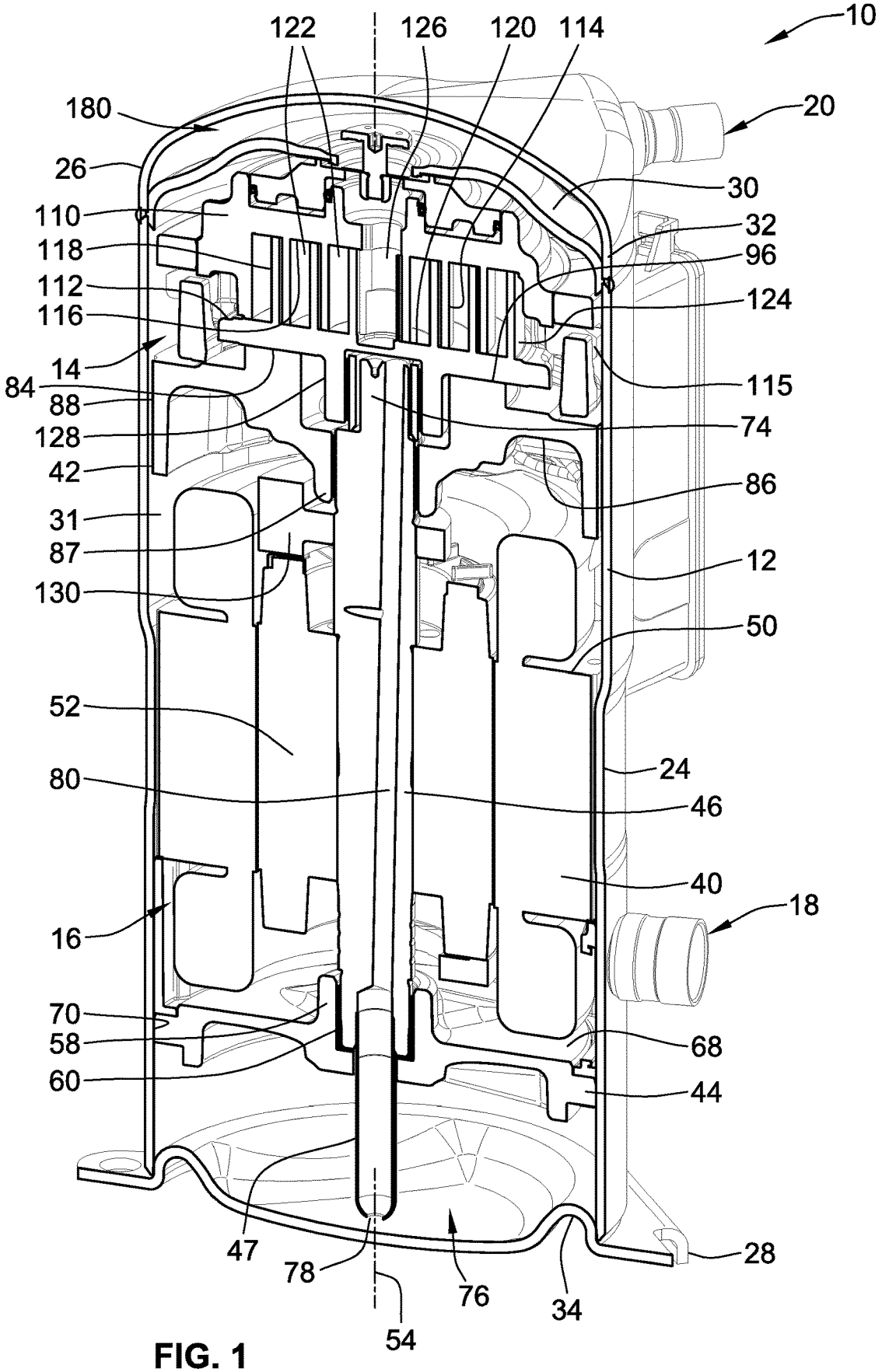
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12. Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the driveshaft 46 for rotation together. The stator 50 is supported by the outer housing 12, either directly or via an adapter. The stator 50 may be press-fit directly into outer housing 12, or may be fitted with adapter (not shown) and press-fit into the outer housing 12. In a particular embodiment, the rotor 52 is mounted on the driveshaft 46, which is supported by upper and lower bearings 42, 44. Energizing the stator 50 is operative to rotatably drive the rotor 52 and thereby rotate the driveshaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the driveshaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the driveshaft 46 has an impeller tube 47 attached at the bottom end of the driveshaft 46. In a particular embodiment, the impeller tube 47 is of a smaller diameter than the driveshaft 46, and is aligned concentrically with the central axis 54. As can be seen from FIG. 1, the driveshaft 46 and impeller tube 47 pass through an opening in the cylindrical hub 58 of the lower bearing member 44. At its upper end, the driveshaft 46 is journaled for rotation within the upper bearing member 42. Upper bearing member 42 may also be referred to as a "crankcase".

The driveshaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the driveshaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the driveshaft 46 is rotated, and thereby pumps oil out of the lubricant sump 76 into an internal lubricant passageway 80 defined within the driveshaft 46. During rotation of the driveshaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
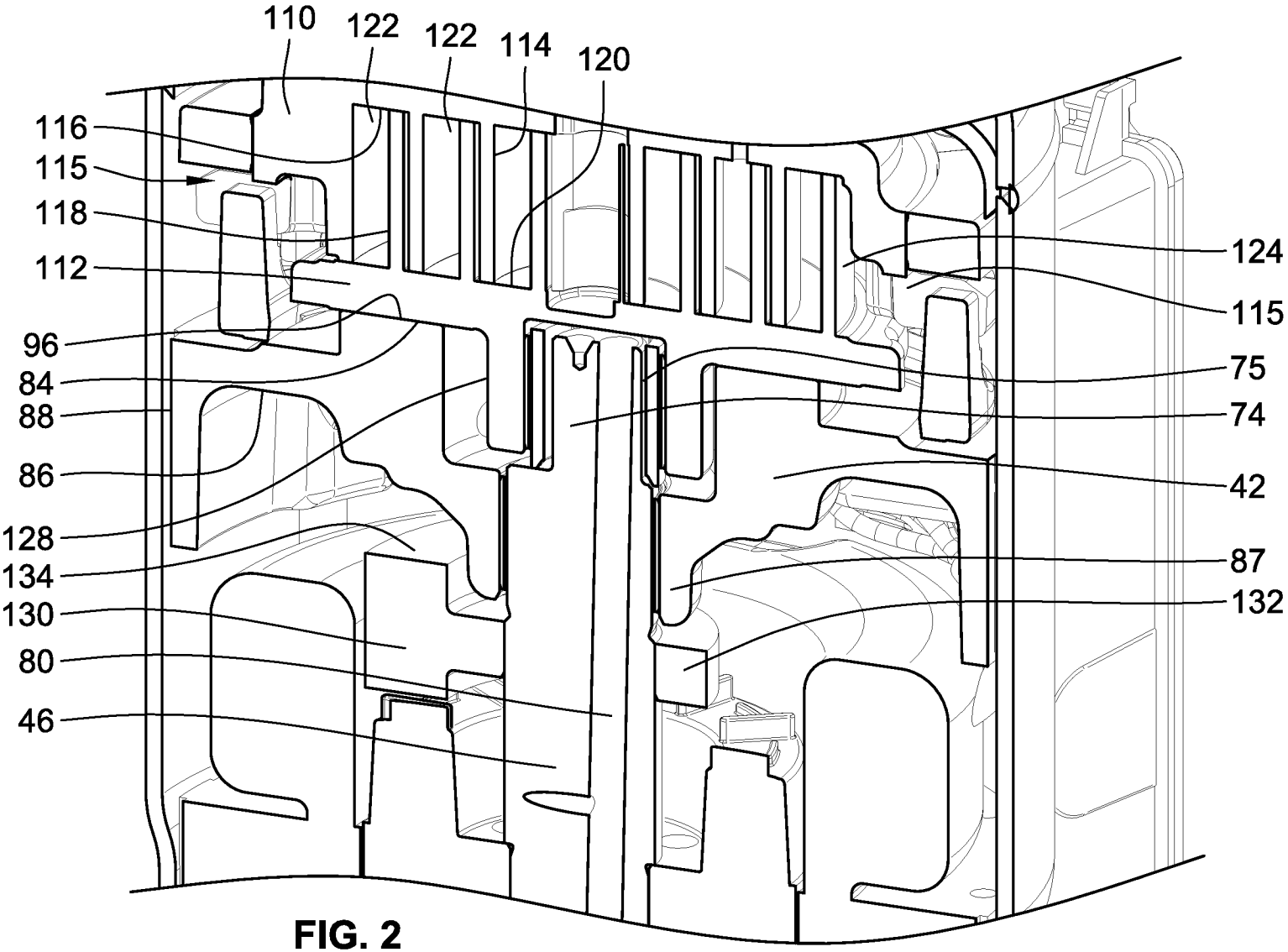
FIG. 2 is a cross-sectional isometric view of an upper portion of the scroll compressor assembly of FIG. 1.
Figure 3:
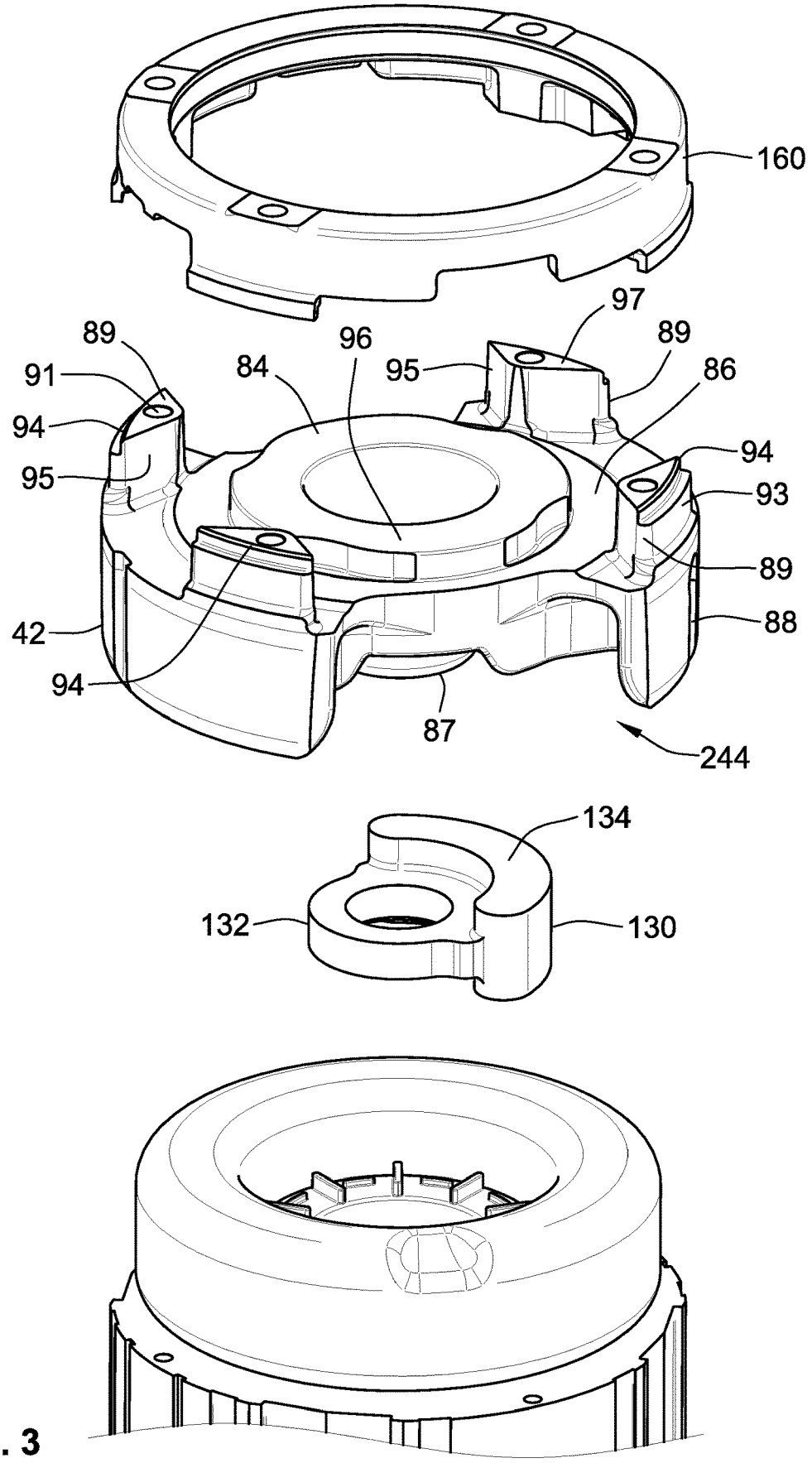
FIG. 3 is an exploded isometric view of selected components of the scroll compressor assembly of FIG. 1.

As shown in FIGS. 2 and 3, the upper bearing member, or crankcase 42 includes a central bearing hub 87 into which the driveshaft 46 is journaled for rotation, and a thrust bearing 84 that supports the movable scroll compressor body 112. (See also FIG. 9). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a bolt or threaded fastener. It is understood that alternate embodiments of the invention may include a crankcase with more or less than four posts, or the posts may be separate components altogether. Alternate embodiments of the invention also include those in which the posts are integral with the pilot ring 160 instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abuts the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 13:
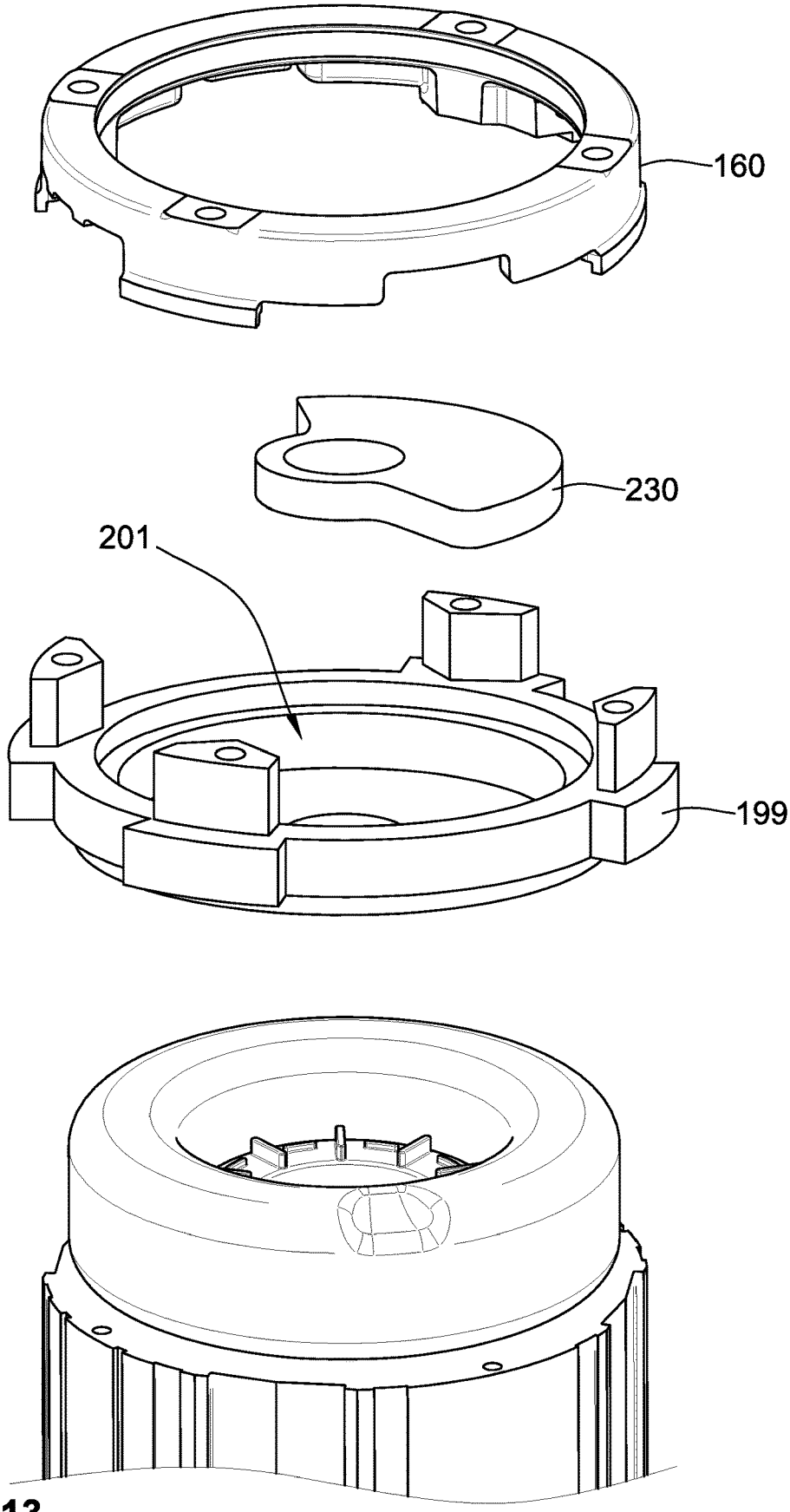
FIG. 13 is an exploded isometric view of selected components for an alternate embodiment of the scroll compressor assembly.
Figure 14:
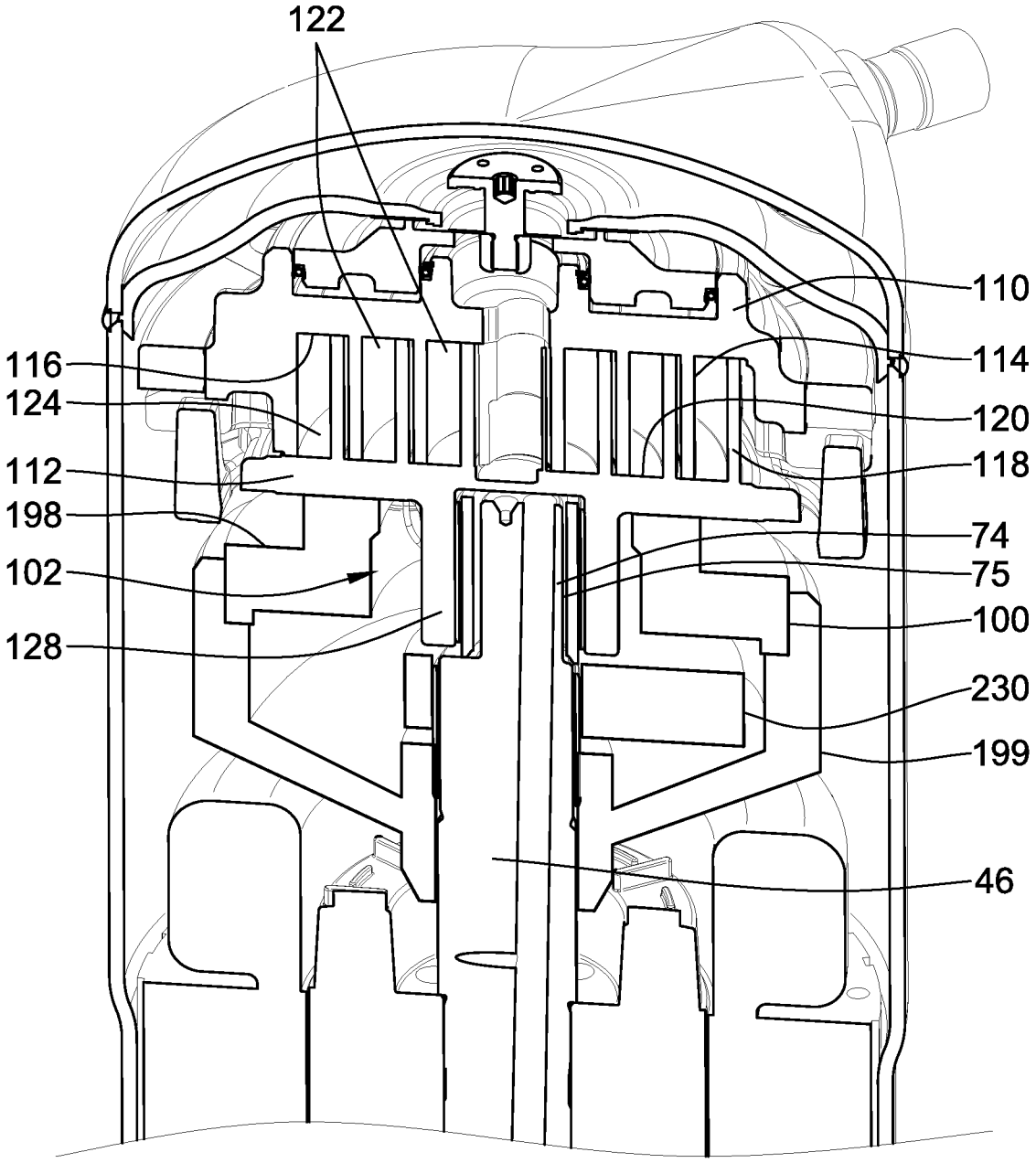
FIG. 14 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of the thrust bearing 84. While, as shown FIGS. 1-3, the crankcase 42 may be integrally provided by a single unitary component, FIGS. 13 and 14 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the driveshaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the driveshaft 46 about the central axis 54. Considering that this offset relationship causes a weight imbalance relative to the central axis 54, the assembly typically includes a counterweight 130 that is mounted at a fixed angular orientation to the driveshaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

Figure 4:
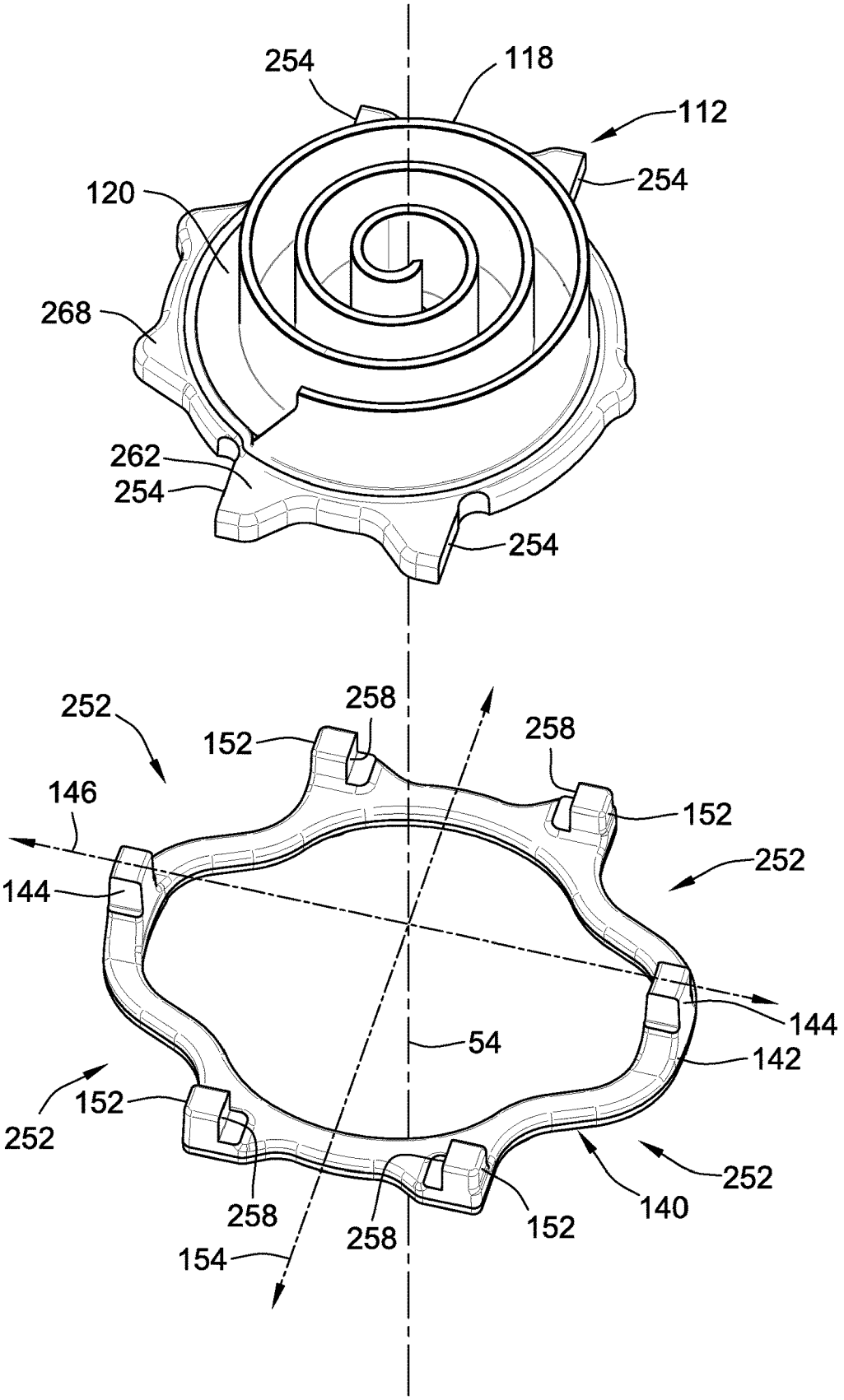
FIG. 4 is a perspective view of an exemplary key coupling and movable scroll compressor body, according to an embodiment of the invention.
Figure 7:
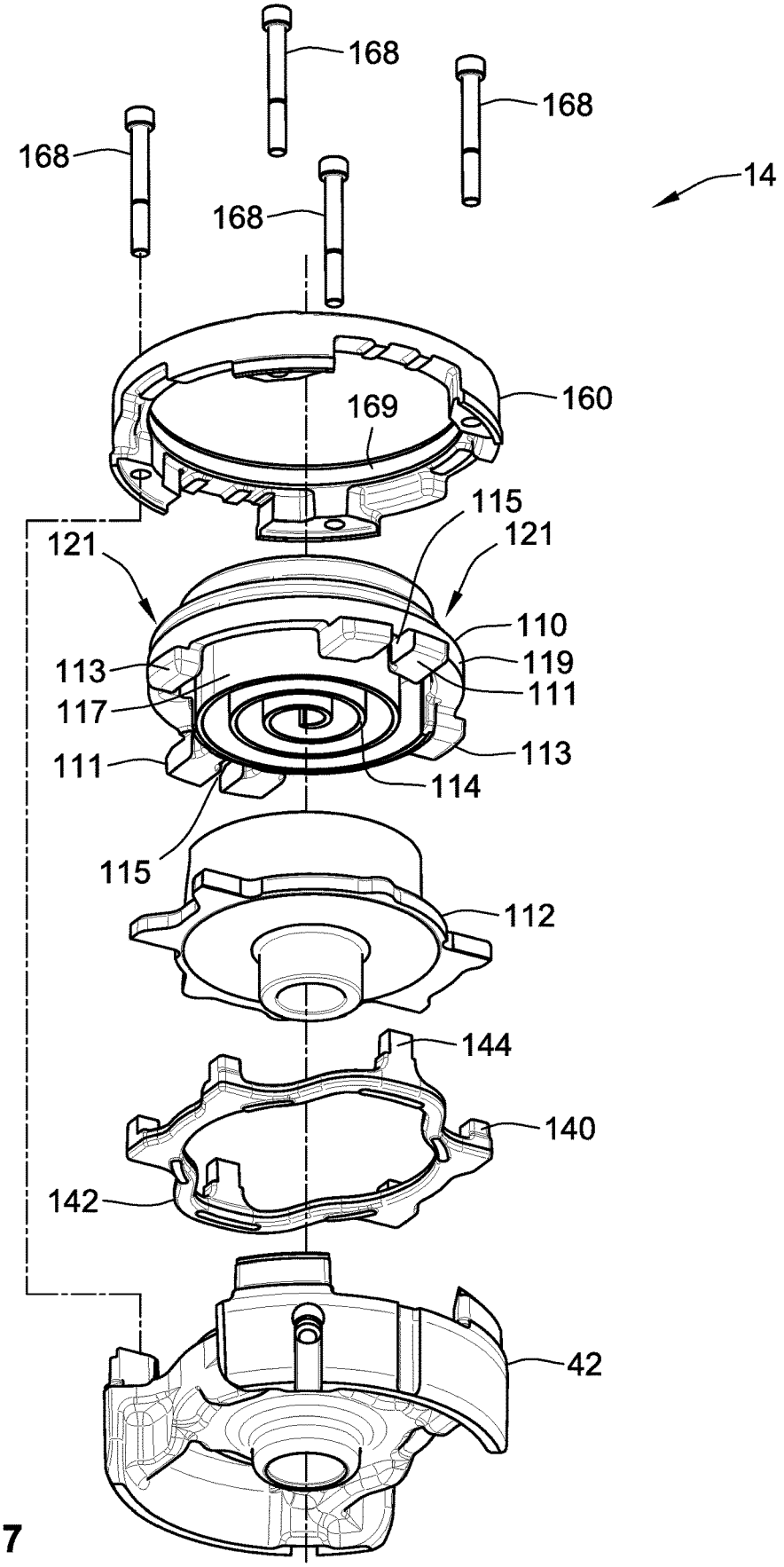
FIG. 7 is an exploded isometric view of the pilot ring, crankcase, key coupler and scroll compressor bodies, according to an embodiment of the invention.

With reference to FIGS. 4 and 7, the guiding movement of the scroll compressor 14 can be seen. To guide the orbital movement of the movable scroll compressor body 112 relative to the fixed scroll compressor body 110, an appropriate key coupling 140 may be provided. Keyed couplings 140 are often referred to in the scroll compressor art as an "Oldham Coupling." In this embodiment, the key coupling 140 includes an outer ring body 142 and includes two axially-projecting first keys 144 that are linearly spaced along a first lateral axis 146 and that slide closely and linearly within two respective keyway tracks or slots 115 (shown in FIGS. 1 and 2) of the fixed scroll compressor body 110 that are linearly spaced and aligned along the first axis 146 as well. The slots 115 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project axially (i.e., parallel to central axis 54) from the ring body 142 of the key coupling 140. This control of movement along the first lateral axis 146 guides part of the overall orbital path of the movable scroll compressor body 112.

Referring specifically to FIG. 4, the key coupling 140 includes four axially-projecting second keys 152 in which opposed pairs of the second keys 152 are linearly aligned substantially parallel relative to a second transverse lateral axis 154 that is perpendicular to the first lateral axis 146. There are two sets of the second keys 152 that act cooperatively to receive projecting sliding guide portions 254 that project from the base 120 on opposite sides of the movable scroll compressor body 112. The guide portions 254 linearly engage and are guided for linear movement along the second transverse lateral axis by virtue of sliding linear guiding movement of the guide portions 254 along sets of the second keys 152.

It can be seen in FIG. 4 that four sliding contact surfaces 258 are provided on the four axially-projecting second keys 152 of the key coupling 140. As shown, each of the sliding contact surfaces 258 is contained in its own separate quadrant 252 (the quadrants 252 being defined by the mutually perpendicular lateral axes 146, 154). As shown, cooperating pairs of the sliding contact surfaces 258 are provided on each side of the first lateral axis 146.

By virtue of the key coupling 140, the movable scroll compressor body 112 has movement restrained relative to the fixed scroll compressor body 110 along the first lateral axis 146 and second transverse lateral axis 154. This results in the prevention of relative rotation of the movable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the movable scroll 112 along the first lateral axis 146 therewith. Additionally, the movable scroll compressor body 112 can independently move relative to the key coupling 140 along the second transverse lateral axis 154 by virtue of relative sliding movement afforded by the guide portions 254 which are received and slide between the second keys 152. By allowing for simultaneous movement in two mutually perpendicular axes 146, 154, the eccentric motion that is afforded by the eccentric offset drive section 74 of the driveshaft 46 upon the cylindrical bushing drive hub 128 of the movable scroll compressor body 112 is translated into an orbital path movement of the movable scroll compressor body 112 relative to the fixed scroll compressor body 110.

The movable scroll compressor body 112 also includes flange portions 268 projecting in a direction perpendicular relative to the guiding flange portions 262 (e.g. along the first lateral axis 146). These additional flange portions 268 are preferably contained within the diametrical boundary created by the guide flange portions 262 so as to best realize the size reduction benefits. Yet a further advantage of this design is that the sliding faces 254 of the movable scroll compressor body 112 are open and not contained within a slot. This is advantageous during manufacture in that it affords subsequent machining operations such as finishing milling for creating the desirable tolerances and running clearances as may be desired.

Figure 5:
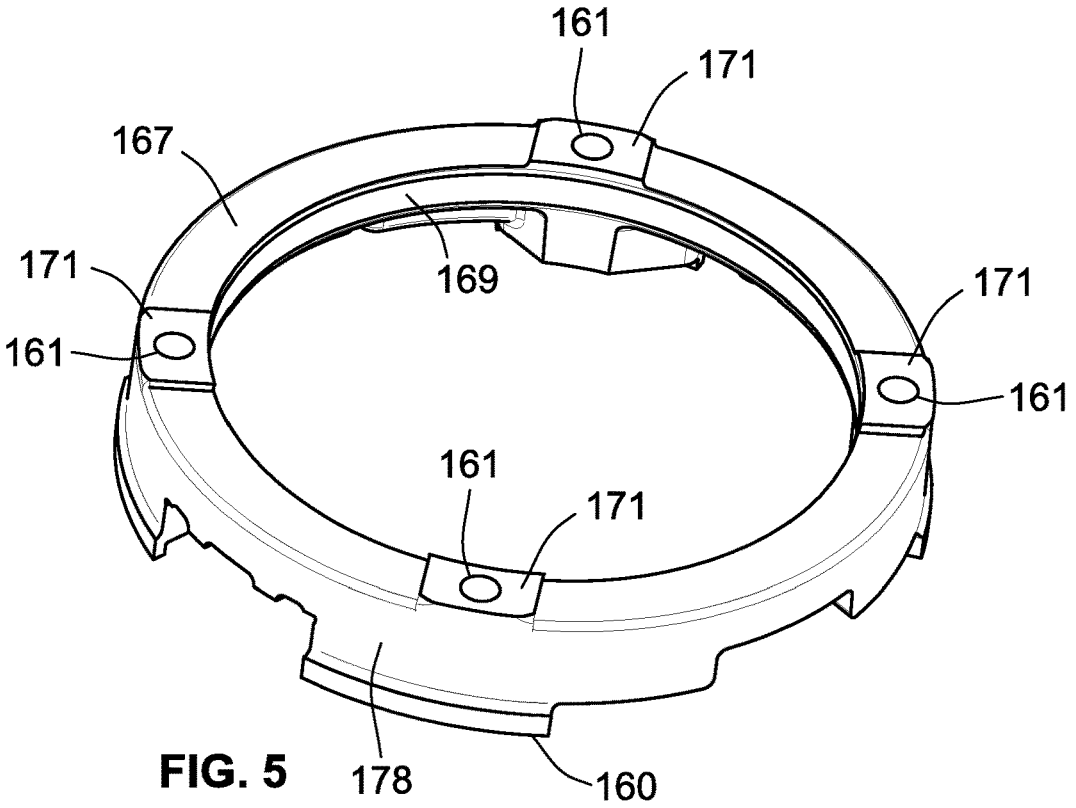
FIG. 5 is a top isometric view of the pilot ring, constructed in accordance with an embodiment of the invention.

Generally, scroll compressors with movable and fixed scroll compressor bodies require some type of restraint for the fixed scroll compressor body 110 which restricts the radial movement and rotational movement but which allows some degree of axial movement so that the fixed and movable scroll compressor bodies 110, 112 are not damaged during operation of the scroll compressor 14. In embodiments of the invention, that restraint is provided by a pilot ring 160, as shown in FIGS. 5-9. FIG. 5 shows the top side of pilot ring 160, constructed in accordance with an embodiment of the invention. The pilot ring 160 has a top surface 167, a cylindrical outer perimeter surface 178, and a cylindrical first inner wall 169. The pilot ring 160 of FIG. 5 includes four holes 161 through which fasteners, such as threaded bolts, may be inserted to allow for attachment of the pilot ring 160 to the crankcase 42. In a particular embodiment, the pilot ring 160 has axially-raised portions 171 (also referred to as mounting bosses) where the holes 161 are located. One of skill in the art will recognize that alternate embodiments of the pilot ring 160 may have greater or fewer than four holes for fasteners. The pilot ring 160 may be a machined metal casting, or, in alternate embodiments, a machined component of iron, steel, aluminum, or some other similarly suitable material.

Figure 6:
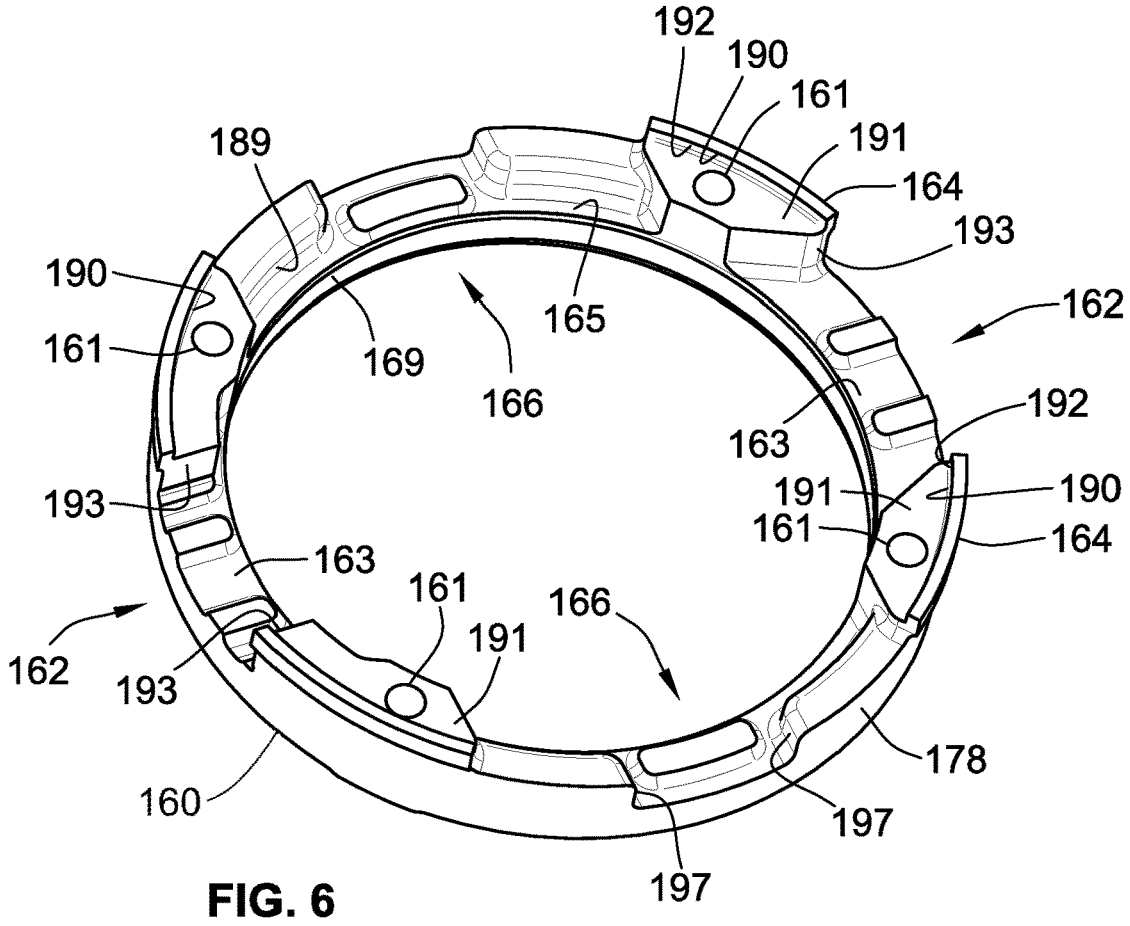
FIG. 6 is a bottom isometric view of the pilot ring of FIG. 5.

FIG. 6 shows a bottom view of the pilot ring 160 showing the four holes 161 along with two slots 162 formed into the pilot ring 160. In the embodiment of FIG. 6, the slots 162 are spaced approximately 180° apart on the pilot ring 160. Each slot 162 is bounded on two sides by axially-extending side walls 193. As shown in FIG. 6, the bottom side of the pilot ring 160 includes a base portion 163 which is continuous around the entire circumference of the pilot ring 160 forming a complete cylinder. But on each side of the two slots 162, there is a semi-circular stepped portion 164 which covers some of the base portion 163 such that a ledge 165 is formed on the part of the pilot ring 160 radially inward of each semi-circular stepped portion 164. The inner-most diameter or the ledge 165 is bounded by the first inner wall 169.

A second inner wall 189 runs along the inner diameter of each semi-circular stepped portion 164. Each semi-circular stepped portion 164 further includes a bottom surface 191, a notched section 166, and a chamfered lip 190. In the embodiment of FIG. 6, each chamfered lip 190 runs the entire length of the semi-circular stepped portion 164 making the chamfered lip 190 semi-circular as well. Each chamfered lip 190 is located on the radially-outermost edge of the bottom surface 191, and extends axially from the bottom surface 191. Further, each chamfered lip 190 includes a chamfered edge surface 192 on an inner radius of the chamfered lip 190. When assembled, the chamfered edge surface 192 is configured to mate with the chamfered edge 94 on each post 89 of the crankcase. The mating of these chamfered surfaces allows for an easier, better-fitting assembly, and reduces the likelihood of assembly problems due to manufacturing tolerances.

In the embodiment of FIG. 6, the notched sections 166 are approximately 180° apart on the pilot ring 160, and each is about midway between the two ends of the semi-circular stepped portion 164. The notched sections 166 are bounded on the sides by sidewall sections 197. Notched sections 166 thus extend radially and axially into the semi-circular stepped portion 164 of the pilot ring 160.

FIG. 7 shows an exploded view of the scroll compressor 14 assembly, according to an embodiment of the invention. The top-most component shown is the pilot ring 160 which is adapted to fit over the top of the fixed scroll compressor body 110. The fixed scroll compressor body 110 has a pair of first radially-outward projecting limit tabs 111. In the embodiment of FIG. 7, one of the pair of first radially-outward projecting limit tabs 111 is attached to an outermost perimeter surface 117 of the first scroll rib 114, while the other of the pair of first radially-outward projecting limit tabs 111 is attached to a perimeter portion of the fixed scroll compressor body 110 below a perimeter surface 119. In further embodiments, the pair of first radially-outward projecting limit tabs 111 are spaced approximately 180 degrees apart. Additionally, in particular embodiments, each of the pair of first radially-outward-projecting limit tabs 111 has a slot 115 therein. In particular embodiments, the slot 115 may be a U-shaped opening, a rectangular-shaped opening, or have some other suitable shape.

The fixed scroll compressor body 110 also has a pair of second radially-outward projecting limit tabs 113, which, in this embodiment, are spaced approximately 180 degrees apart. In certain embodiments, the second radially-outward projecting limit tabs 113 share a common plane with the first radially-outward-projecting limit tabs 111. Additionally, in the embodiment of FIG. 7, one of the pair of second radially-outward projecting limit tabs 113 is attached to an outermost perimeter surface 117 of the first scroll rib 114, while the other of the pair of second radially-outward projecting limit tabs 113 is attached to a perimeter portion of the fixed scroll compressor body 110 below the perimeter surface 119. The movable scroll compressor body 112 is configured to be held within the keys of the key coupling 140 and mates with the fixed scroll compressor body 110. As explained above, the key coupling 140 has two axially-projecting first keys 144, which are configured to be received within the slots 115 in the first radially-outward-projecting limit tabs 111. When assembled, the key coupling 140, fixed and movable scroll compressor bodies 110, 112 are all configured to be disposed within crankcase 42, which can be attached the to the pilot ring 160 by the threaded bolts 168 shown above the pilot ring 160.

Referring still to FIG. 7, the fixed scroll compressor body 110 includes plate-like base 116 (see FIG. 14) and a perimeter surface 119 spaced axially from the plate-like base 116. In a particular embodiment, the entirety of the perimeter surface 119 surrounds the first scroll rib 114 of the fixed scroll compressor body 110, and is configured to abut the first inner wall 169 of the pilot ring 160, though embodiments are contemplated in which the engagement of the pilot ring 160 and fixed scroll compressor body involve less than the entire circumference. In particular embodiments of the invention, the first inner wall 169 is precisely toleranced to fit snugly around the perimeter surface 119 to thereby limit radial movement of the first scroll compressor body 110, and thus provide radial restraint for the first scroll compressor body 110. The plate-like base 116 further includes a radially-extending top surface 121 that extends radially inward from the perimeter surface 119. The radially-extending top surface 121 extends radially inward towards a step-shaped portion 123 (see FIG. 8). From this step-shaped portion 123, a cylindrical inner hub region 172 and peripheral rim 174 extend axially (i.e., parallel to central axis 54, when assembled into scroll compressor assembly 10).

Figure 8:
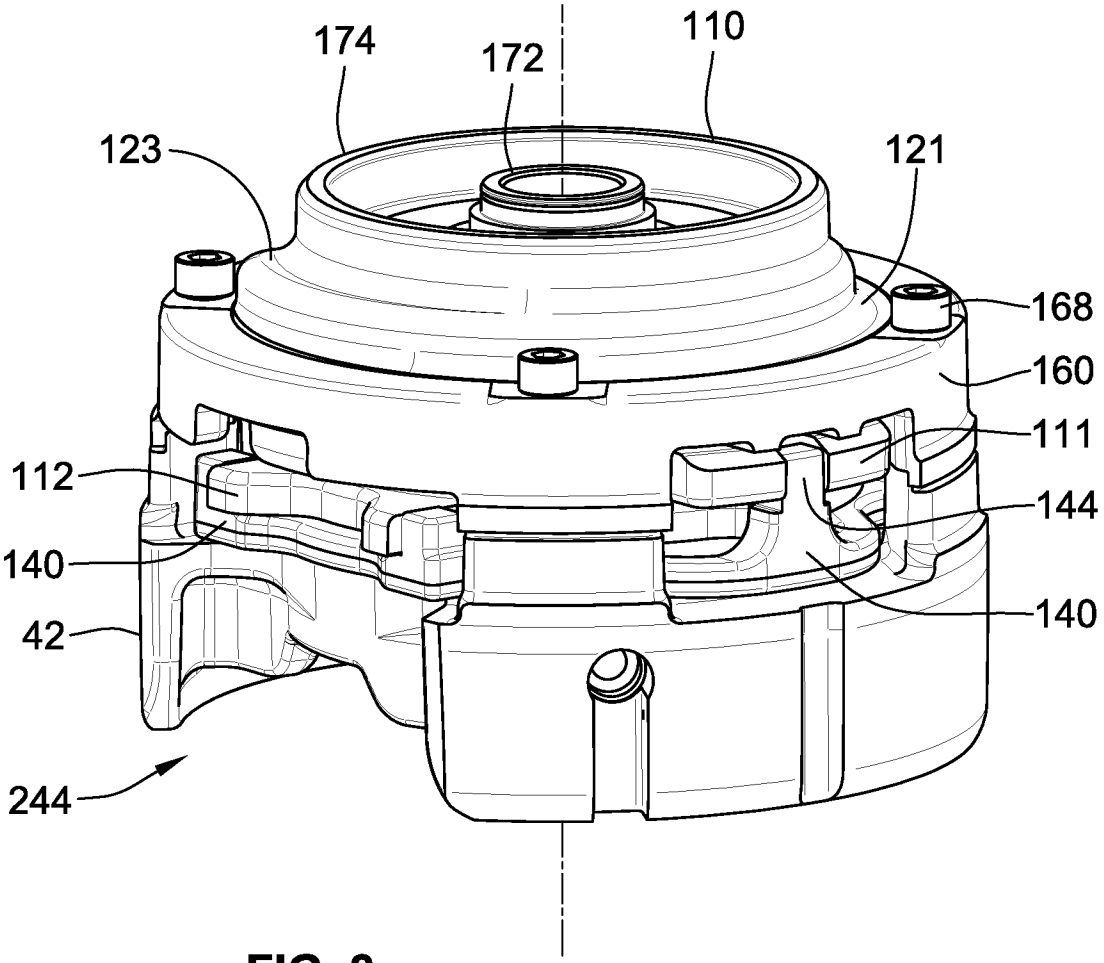
FIG. 8 is a isometric view of the components of FIG. 7 shown assembled.

FIG. 8 shows the components of FIG. 7 fully assembled. The pilot ring 160 securely holds the fixed scroll compressor body 110 in place with respect to the movable scroll compressor body 112 and key coupling 140. The threaded bolts 168 attach the pilot ring 160 and crankcase 42. As can be seen from FIG. 8, each of the pair of first radially-outward projecting limit tabs 111 is positioned in its respective slot 162 of the pilot ring 160. As stated above, the slots 115 in the pair of first radially-outward projecting limit tabs 111 are configured to receive the two axially-projecting first keys 144. In this manner, the pair of first radially-outward projecting limit tabs 111 engage the side portion 193 of the pilot ring slots 162 to prevent rotation of the fixed scroll compressor body 110, while the key coupling first keys 144 engage a side portion of the slot 115 to prevent rotations of the key coupling 140. Limit tabs 111 also provide additional (to limit tabs 113) axial limit stops.

Though not visible in the view of FIG. 8, each of the pair of second radially-outward projecting limit tabs 113 (see FIG. 7) is nested in its respective notched section 166 of the pilot ring 160 to constrain axial movement of the fixed scroll compressor body 110 thereby defining a limit to the available range of axial movement of the fixed scroll compressor body 110. The pilot ring notched sections 166 are configured to provide some clearance between the pilot ring 160 and the pair of second radially-outward projecting limit tabs 113 to provide for axial restraint between the fixed and movable scroll compressor bodies 110, 112 during scroll compressor operation. However, the radially-outward projecting limit tabs 113 and notched sections 166 also keep the extent of axial movement of the fixed scroll compressor body 110 to within an acceptable range.

It should be noted that "limit tab" is used generically to refer to either or both of the radially-outward projecting limit tabs 111, 113. Embodiments of the invention may include just one of the pairs of the radially-outward projecting limit tabs, or possibly just one radially-outward projecting limit tab, and particular claims herein may encompass these various alternative embodiments As illustrated in FIG. 8, the crankcase 42 and pilot ring 160 design allow for the key coupling 140, and the fixed and movable scroll compressor bodies 110, 112 to be of a diameter that is approximately equal to that of the crankcase 42 and pilot ring 160. As shown in FIG. 1, the diameters of these components may abut, or nearly abut, the inner surface of the outer housing 12, and, as such, the diameters of these components are approximately equal to the inner diameter of the outer housing 12. It is also evident that when the key coupling 140 is as large as the surrounding compressor outer housing 12 allows, this in turn provides more room inside the key coupling 140 for a larger thrust bearing which in turn allows a larger scroll set. This maximizes the scroll compressor 14 displacement available within a given diameter outer housing 12, and thus uses less material at less cost than in conventional scroll compressor designs.

It is contemplated that the embodiments of FIGS. 7 and 8 in which the first scroll compressor body 110 includes four radially-outward projecting limit tabs 111, 113, these limit tabs 111, 113 could provide radial restraint of the first scroll compressor body 110, as well as axial and rotation restraint. For example, radially-outward projecting limit tabs 113 could be configured to fit snugly with notched sections 166 such that these limit tabs 113 sufficiently limit radial movement of the first scroll compressor body 110 along first lateral axis 146. Additionally, each of the radially-outward-projecting limit tabs 111 could have a notched portion configured to abut the portion of the first inner wall 169 adjacent the slots 162 of the pilot ring 160 to provide radial restraint along second lateral axis 154. While this approach could potentially require maintaining a certain tolerance for the limit tabs 111, 113 or the notched section 166 and slots 162, in these instances, there would be no need to precisely tolerance the entire first inner wall 169 of the pilot ring 160, as this particular feature would not be needed to provide radial restraint of the first scroll compressor body 110.

Figure 12:
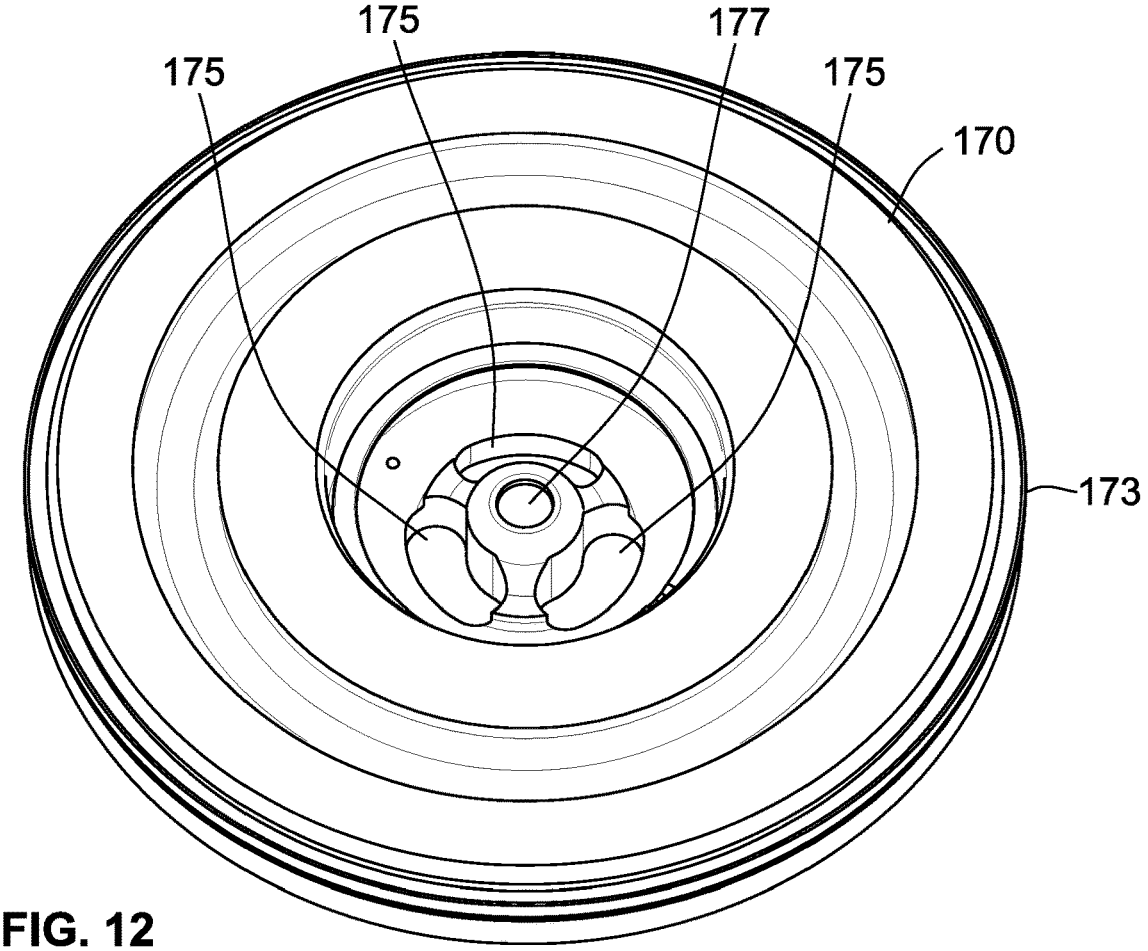
FIG. 12 is a bottom isometric view of the floating seal of FIG. 11.

With reference to FIGS. 9-12, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 12, the underside of the floating seal 170 has circular cutout adapted to accommodate the inner hub region 172 of the fixed scroll compressor body 110. Further, as can be seen from FIGS. 9 and 10, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 9:
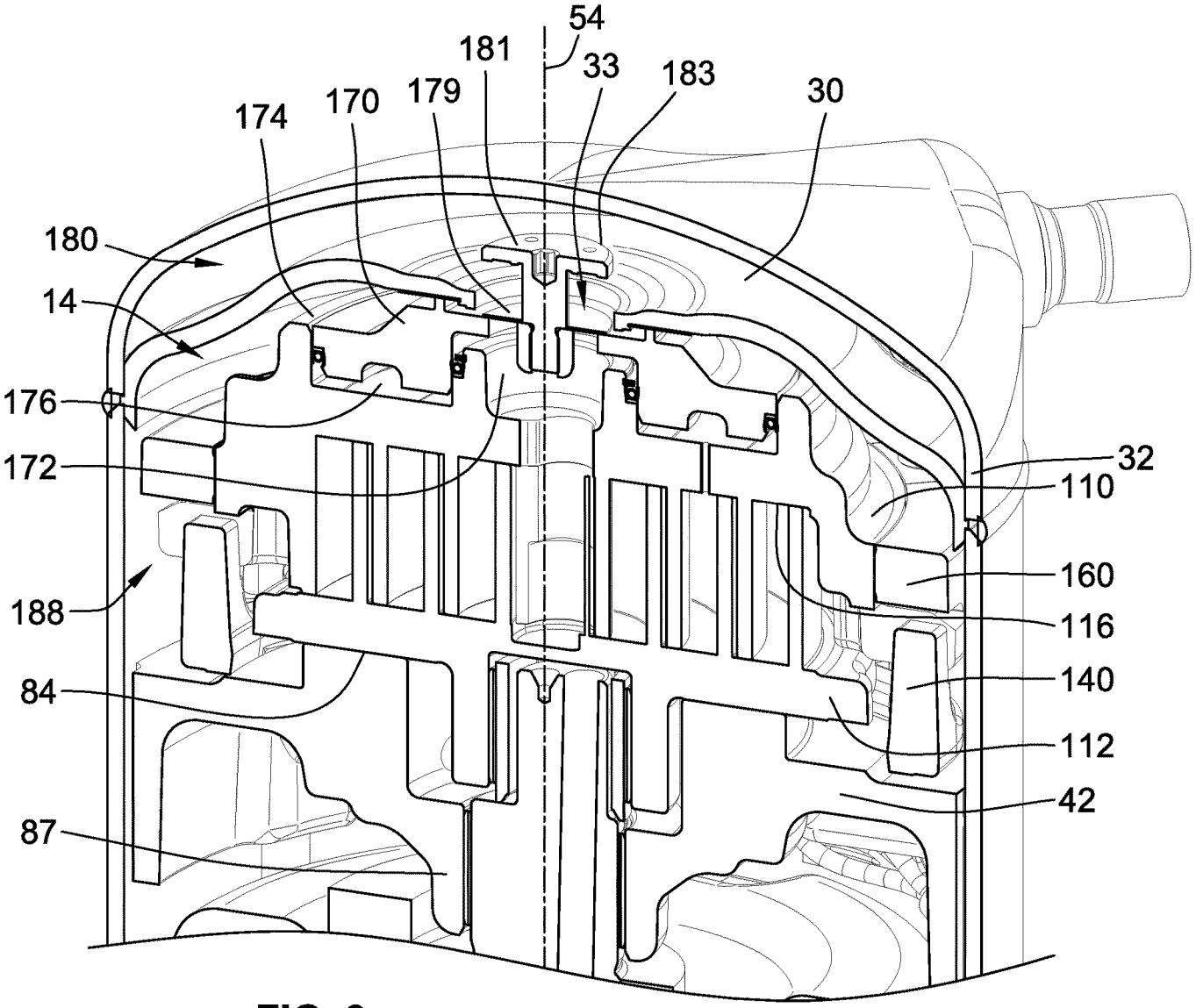
FIG. 9 is a cross-sectional isometric view of the components in the top end section of the outer housing, according to an embodiment of the invention.
Figure 10:
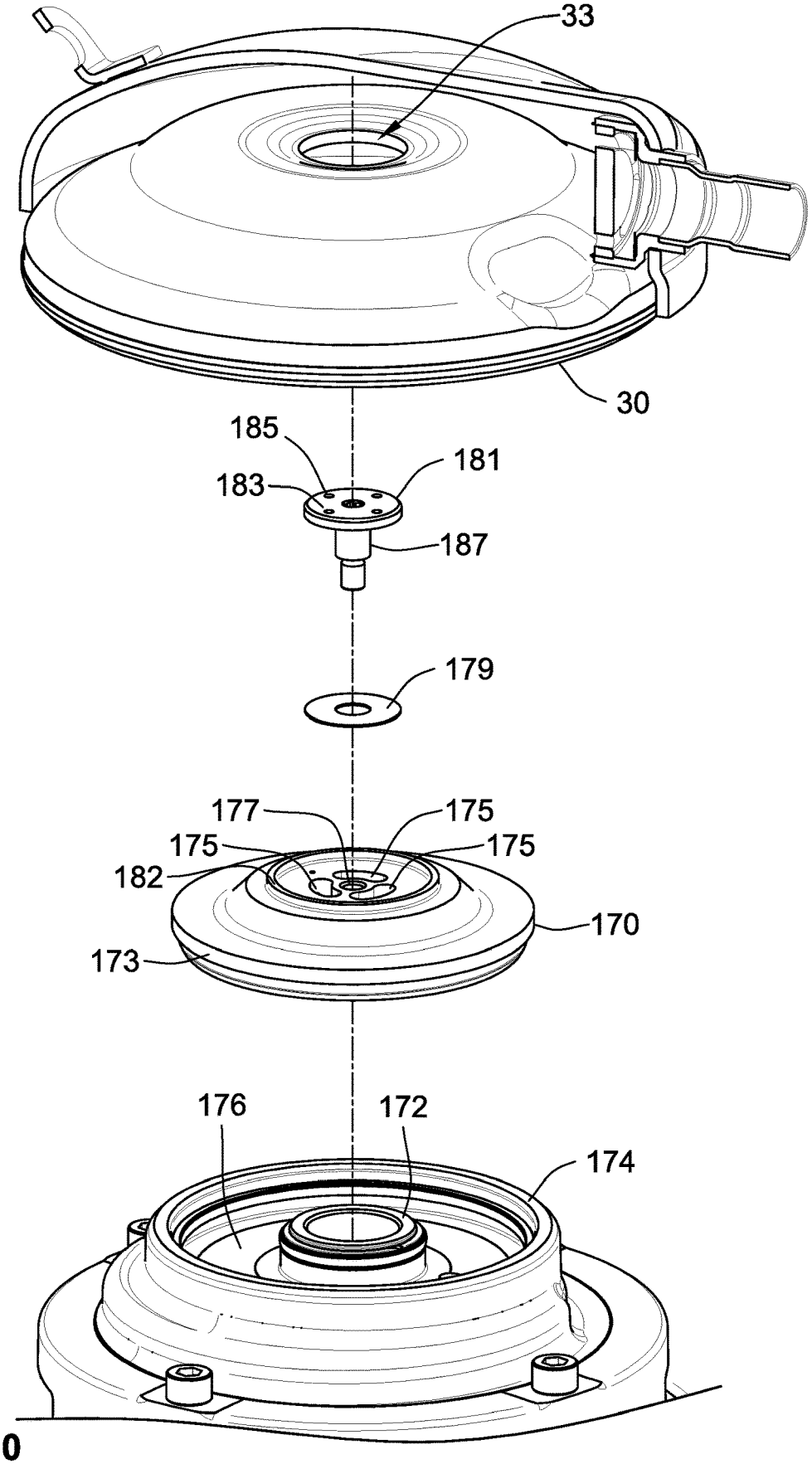
FIG. 10 is an exploded isometric view of the components of FIG. 9.
Figure 11:
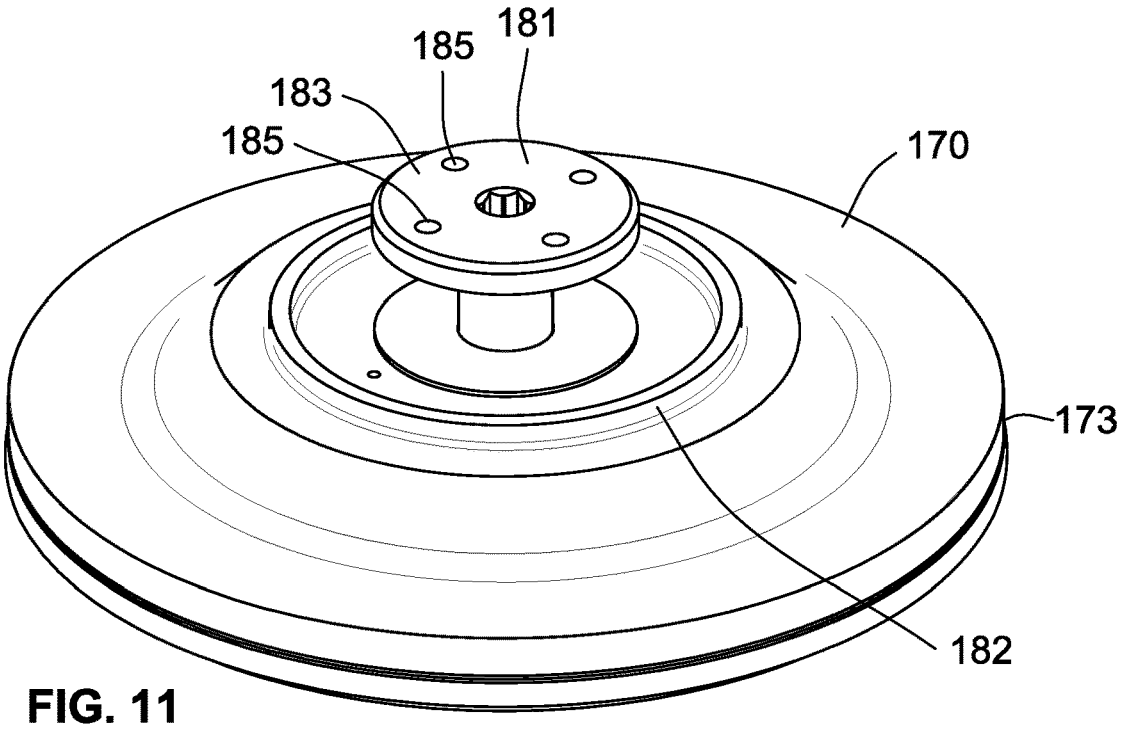
FIG. 11 is a top isometric view of the floating seal, according to an embodiment of the invention.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 9 through 12, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 9, the pin through separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180. With this arrangement, the combination of the separator plate 30, and the fixed scroll compressor body 110, and floating seal 170 serve to separate the high pressure chamber 180 from a lower pressure region 188 within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 9). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 heat which can be generated by operation of the motor. Low-pressure refrigerant can then pass longitudinally through the electrical motor assembly 40, around and through void spaces therein toward the scroll compressor 14. The low-pressure refrigerant fills the chamber 31 formed between the electrical motor assembly 40 and the outer housing 12. From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 13 and 14 illustrate an alternate embodiment of the invention. Instead of a crankcase 42 formed as a single piece, FIGS. 13 and 14 show an upper bearing member or crankcase 199 combined with a separate collar member 198, which provides axial thrust support for the scroll compressor 14. In a particular embodiment, the collar member 198 is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 13 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

Figure 15:
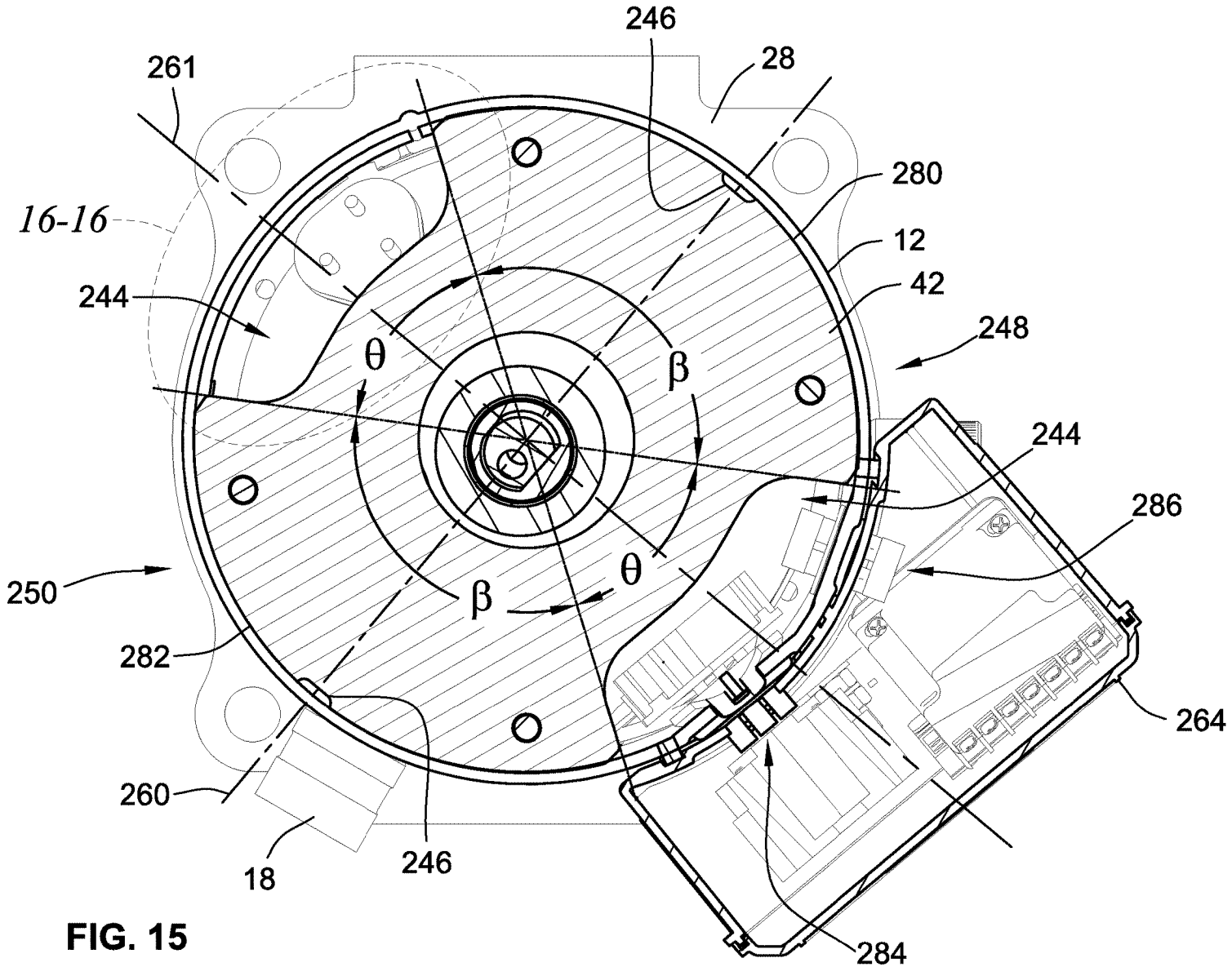
FIG. 15 is a top cross-sectional view illustrating in cross section of a crankcase of the scroll compressor.

Turning now to FIG. 15 (and with additional reference to FIG. 3 showing crankcase 42), the crank case 42 is shown in a top cross-sectional view and has a generally I-shaped profile. Openings 244 of crank case 42 are also shown. As can be seen from inspection of FIG. 15, there are two larger openings 244 for refrigerant flow (also referred to as gas passages), and/or electrical component placement, and two smaller drainage ports 246 for lubricant drainage. Passages 244 are positioned between a pair of preferably symmetrical cylindrical sections 248, 250. At least one drainage port 246 is formed on each cylindrical section 248, 250. In other embodiments, more drainage ports 246 may be presented through each cylindrical section 248, 250, or only one cylindrical section 248, 250 may incorporate a single or multiple drainage ports 246.

Crank case 42 includes a pair of contact regions 280, 282 that are generally cylindrical surfaces extending axially along the height of the crankcase 42. One contact region 280 is defined by cylindrical section 248, while the other contact region 282 is defined by cylindrical section 250. Each contact region 280, 282 is in contact with an inner peripheral surface of housing 12. Contact regions 280, 282 are centered along axis 260. Contact regions 280, 282 may contact the interior of the housing 12 by way of an interference fit when crank case 42 is press fit into housing 12. More specifically, crankcase 42 is press fit into housing 12 such that an inner radius of housing 12 is less than the outer radius of each cylindrical section 248, 250 at the openings 244 relative to axis 54 (See FIG. 1). Further, each cylindrical section 248, 250 connects two adjacent posts 89, and each opening 244 separates two adjacent posts 89 (See also FIG. 3).

Openings 244 are centered along axis 261 as illustrated and provide gaps between cylindrical sections 248, 250. As is shown in FIG. 15, axes 260, 261 are generally perpendicular to one another. Further, each of openings 244 extends about the circumference of crank case 42 at an angular span θ as shown. Each of cylindrical section 248, 250 (and thus each contact region 280, 282) of crank case 42 extends about the circumference of crank case 42 at an angular span β as shown. As is evident from FIG. 15 the angle β is greater than the angle θ.

In one embodiment, θ is about 50° to about 80°, and more preferably about 60° to about 70°. Likewise, β is about 130° to about 100°, and more preferably about 120° to about 110°. Other angles are, however, contemplated within the scope of the invention. Indeed, in one embodiment, θ could be about 50° to about 150°, with β making up the respective supplementary angle.

Those skilled in the art will also recognize from inspection of FIG. 15 that multiple electrical terminations in the form of connectors 284, 286 can be co-located in a single gas passage, i.e. opening 244, unlike prior designs. As one advantage of such a configuration, only a single terminal box 264 may be required to protect the connection points thereof. Put differently, the increased size of each opening 244 allows for all of the electrical termination of the compressor to be positioned within a single opening 244, and thus only a single terminal box is needed to cover and protect all of the electrical termination of the compressor.

Figure 16:
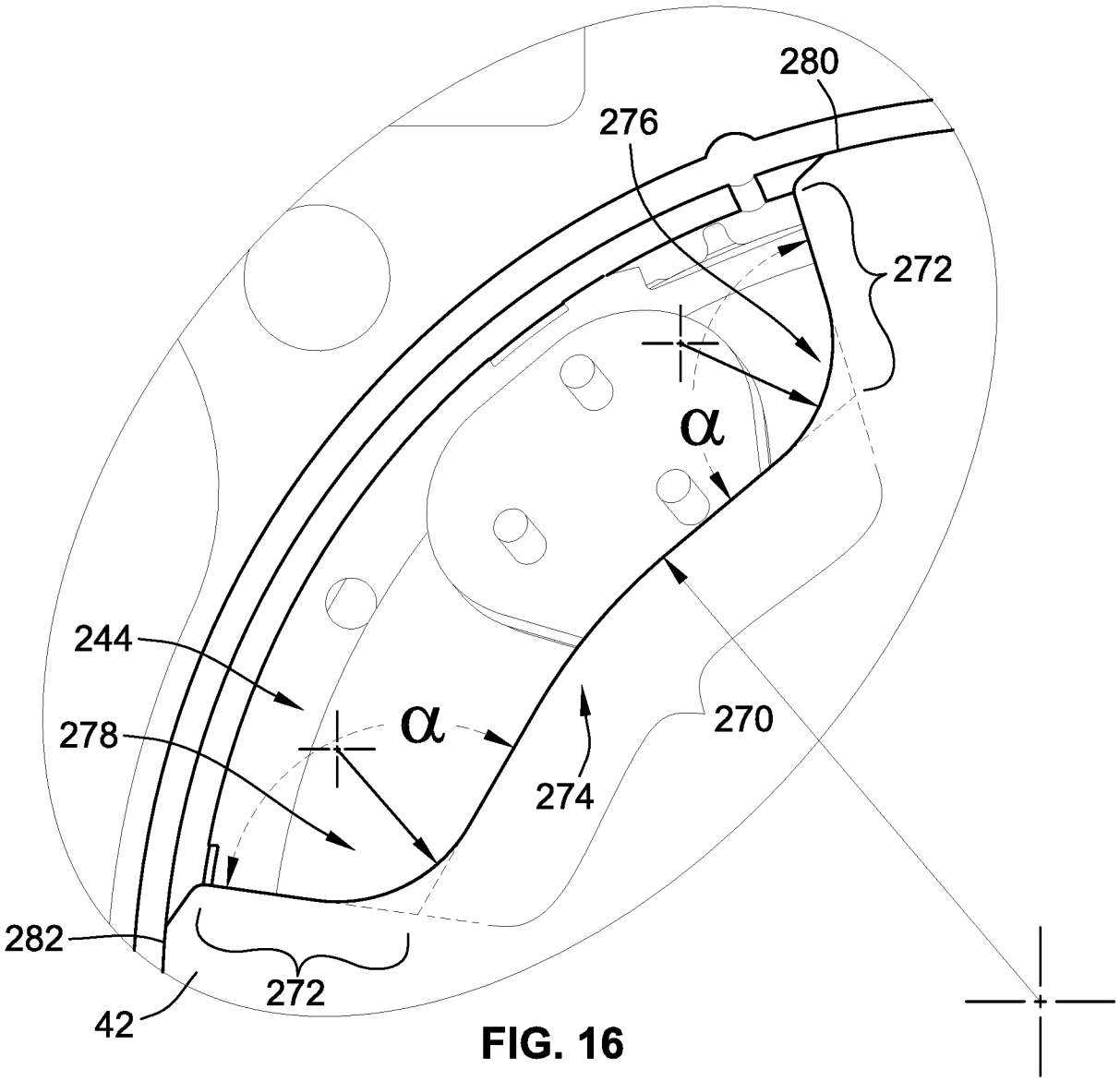
FIG. 16 is a partial top view of the crankcase of FIG. 15, particularly a gas passage thereof.

Turning now to FIG. 16, the particular shape of each opening 244 will be described in greater detail. As shown at FIG. 16, each opening 244 includes a base portion 270 that is the radially inward defining face of each opening 244, and sidewall portions 272 disposed on either side of base portion 270 that extend radially outward from the base portion 270 to the contact regions 280, 282. Each sidewall portion 272 extends away from the base portion 270 at an angle α. As shown at FIG. 16, the angle α is greater than 90°. However, in other embodiments, the angle can be equal to or less than 90°.

Base portion 270 includes a convex portion 274 relative to axis 54 (See FIG. 1). Disposed on either side of convex portion 274 are concave portions 276, 278. As such, base portion 270 generally has an undulating or wave-like surface contour as illustrated.

Each opening 244 extends radially inward from a circumference of the crankcase 42 and axially through the crankcase 42 as illustrated. The depth of each opening 244 is less than half of the radius of crank case 42. However, in other embodiments, each opening 244 may exceed half of the radius of crank case 42, or be less than the radial depth illustrated. Other shapes for passages 244 are contemplated, ideally also allowing for the co-location of multiple electrical terminations.

Figure 17:
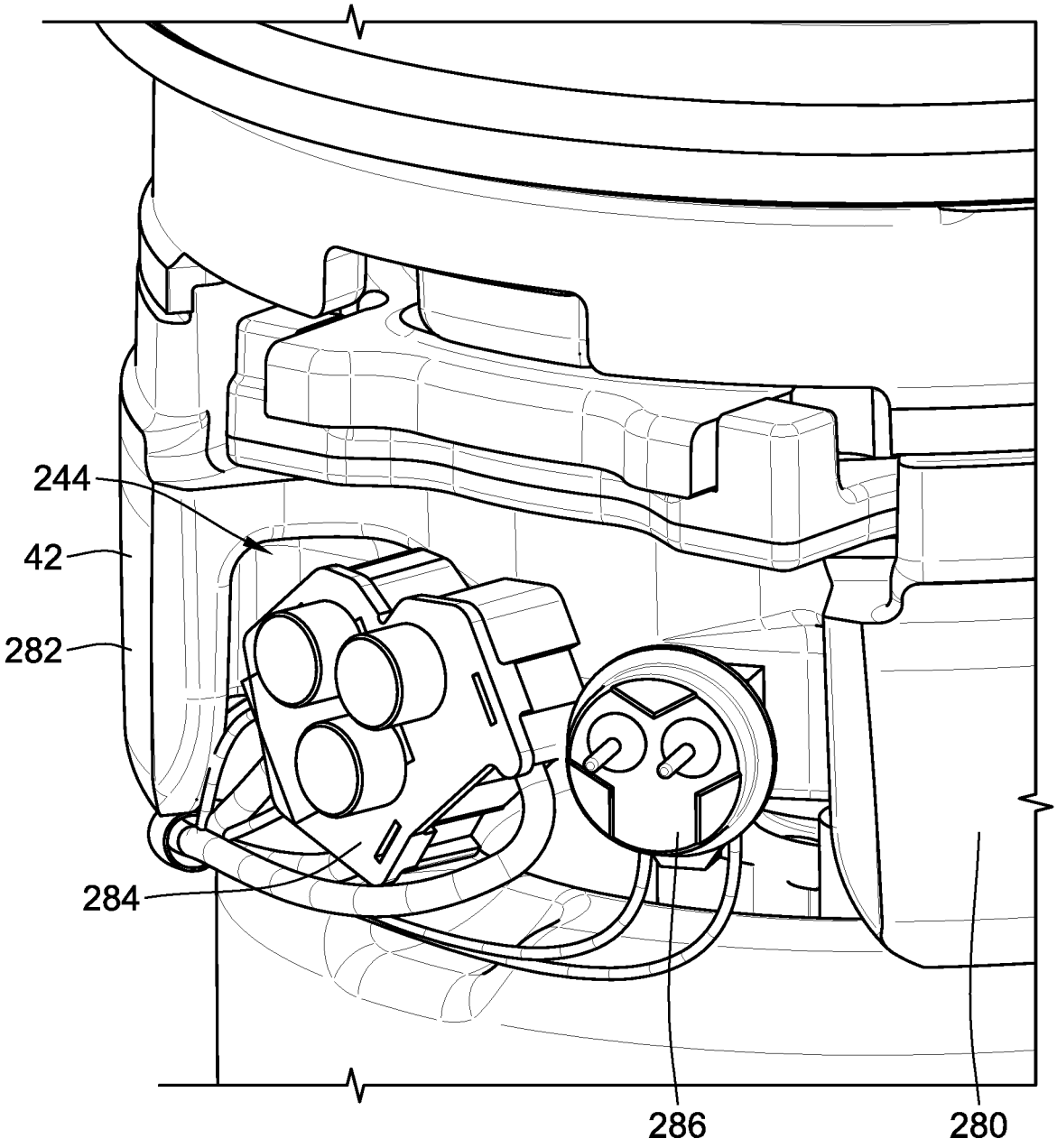
FIG. 17 is a partial perspective view of another gas passage of the crankcase of FIG. 15, with various electrical connectors positioned therein.

Turning now to FIG. 17, each of connectors 284, 286 are shown positioned within a single opening 244 of crank case 42. In the illustrated embodiment, connector 284 is an electrical power connector for the motor. Connector 286 is a high limit temperature switch. Those skilled in the art will recognize, however, that other types of connectors could be positioned within opening 244. Indeed, additional sensors or the like could also be included in opening 244 in the particular embodiment, advantageously all of the elements that will connect to an exterior electrical connector are positioned within a single opening 244 in a side-by-side relationship. Therefore, a single, small, terminal box enclosure 264 can be utilized. Other advantages that may be additionally or alternatively realized include space savings, press fitting symmetry, material savings, and also may conveniently provide posts for supporting a pilot ring for scroll compliance purposes.

As illustrated in FIG. 15, and mentioned above, the crankcase 42 includes two cylindrical or cylinder sections 248 and 250 that are shown to both span an angle β. Further, the cylinder sections 248 and 250 include cylindrical surfaces or contact regions 280 and 282, respectively. The contact regions 280, 282 are surfaces that make contact with an inner surface of the shell 12, during installation.

Figure 18:
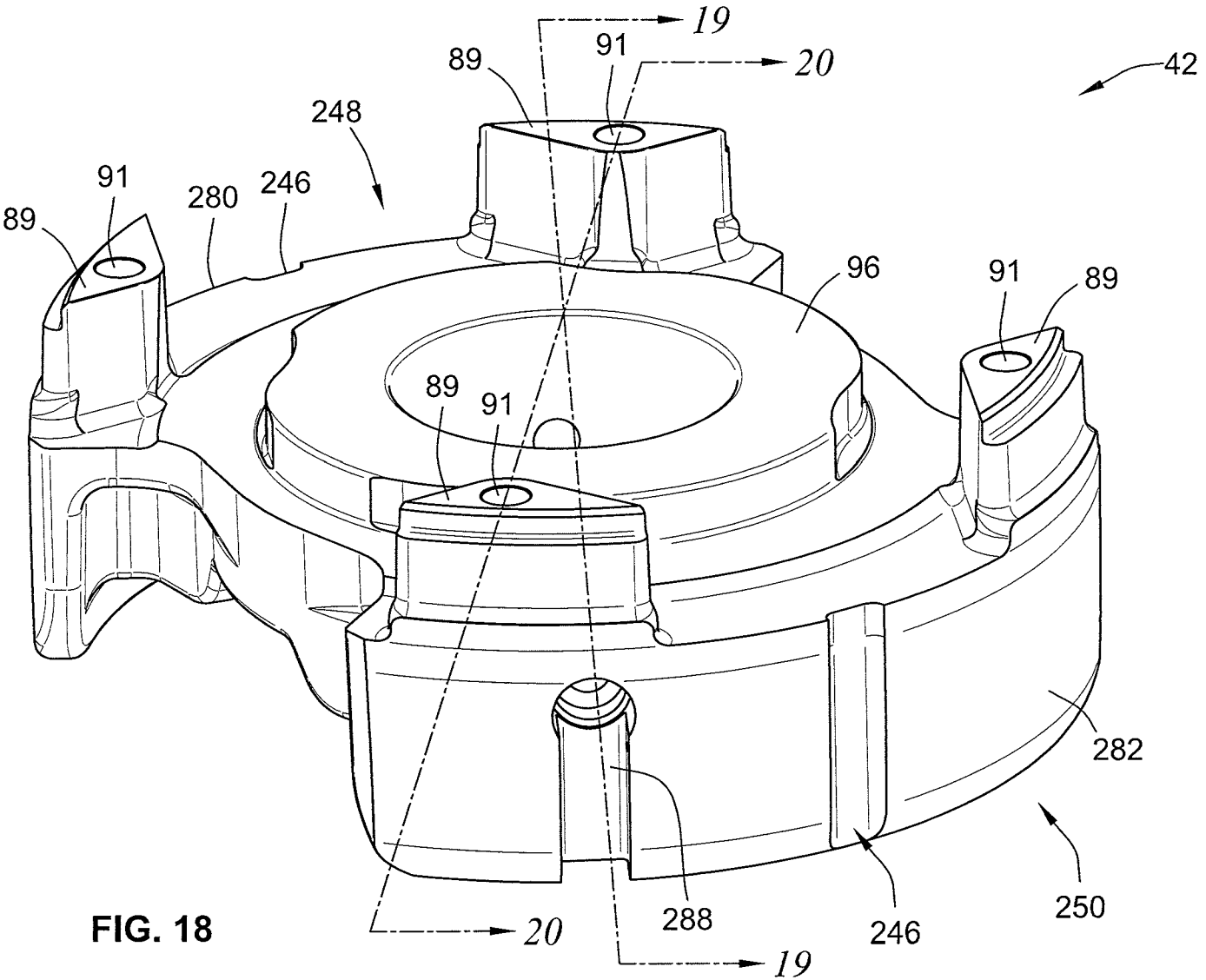
FIG. 18 is an isometric view illustrating the crankcase of the scroll compressor.

Turning now to FIG. 18, an up-close illustration of the crankcase 42 is provided. The contact regions 280 and 282 include drainage ports 246, which span the entire vertical length of the contact regions 280 and 282 such that the lubricant oil used to lubricate surfaces between scroll bodies and the axial thrust surface 96 can drain, under the force of gravity, downward toward the sump 76 (See FIG. 1). Additionally, an internal lubricant oil drainage duct 288 is included. Drainage duct 288 spans an internal length between both contact regions 280 and 282 such that a passage for lubricating oil that is caught between the common surfaces of the crankcase 42 and the thrust bearing 84 (See FIG. 2) can drain from the internal structure of the crankcase 42 downward toward the sump 76 (See FIG. 1).

Figure 19:
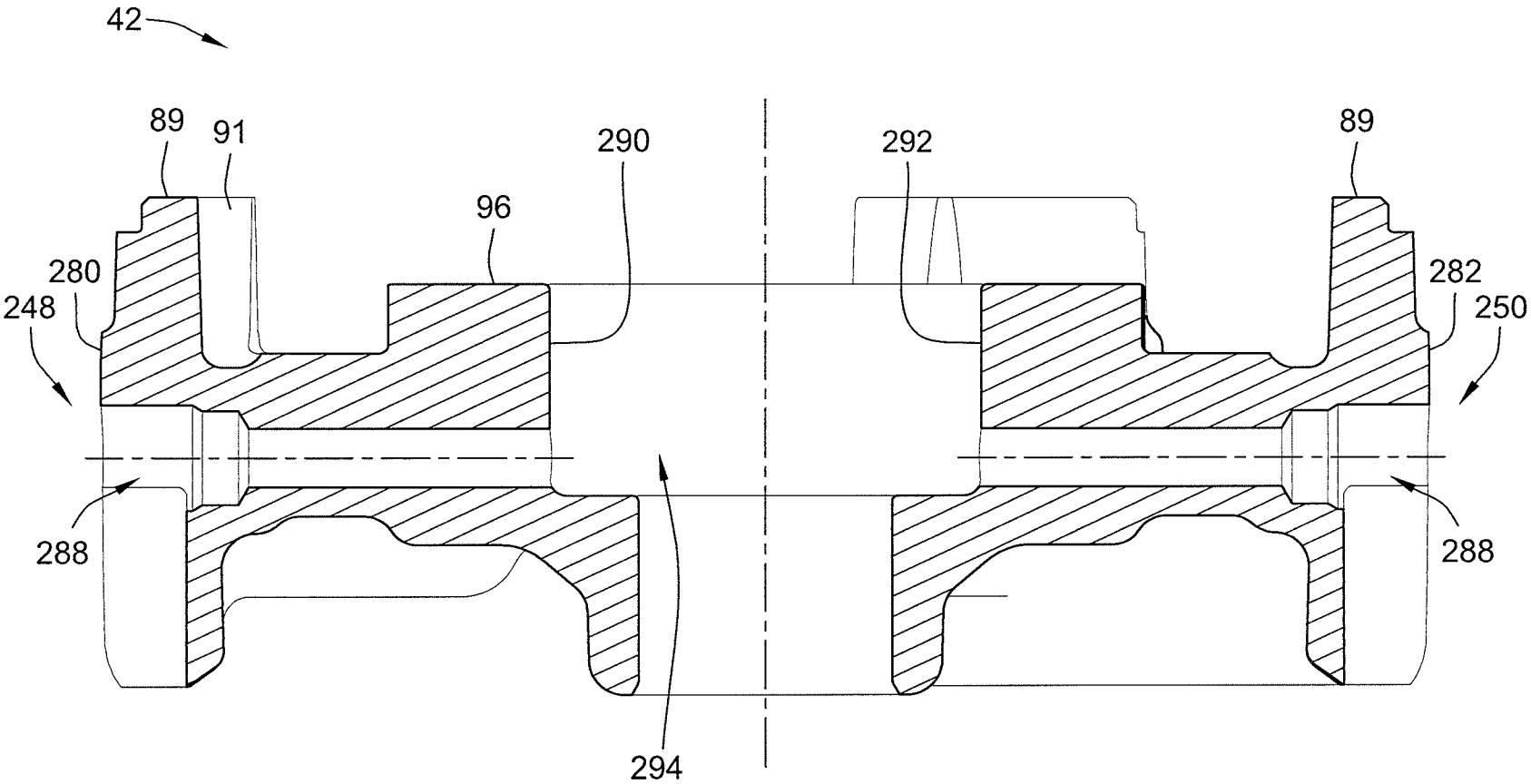
FIG. 19 is a cross-sectional view of the crankcase of FIG. 18 illustrating a lubricant drainage passage.

FIG. 19 illustrates a cross section of the crankcase 42 through the drainage duct 288. The drainage duct 288 functions to allow lubricant oil that is trapped between inner walls 290 and 292 of the crankcase 42 to drain downward toward the sump 76 (see FIG. 1). Crankcase 42 includes a thrust bearing cavity 294 that defines a space where both the crankcase 42 and thrust bearing 84 have surfaces in close proximity (see FIG. 2). A certain amount of lubricant oil used to lubricate the scroll bodies will become trapped inside the thrust bearing cavity 294 between the thrust bearing 84 and the inner walls 290 and 292 of the crankcase 42. Drainage duct 288 provides a passage for this excess lubricant oil to drain toward the inner surface of the housing such that it can drain downward along the inner surface of the housing 12 toward the sump 76 (see FIG. 1).

Figure 20:
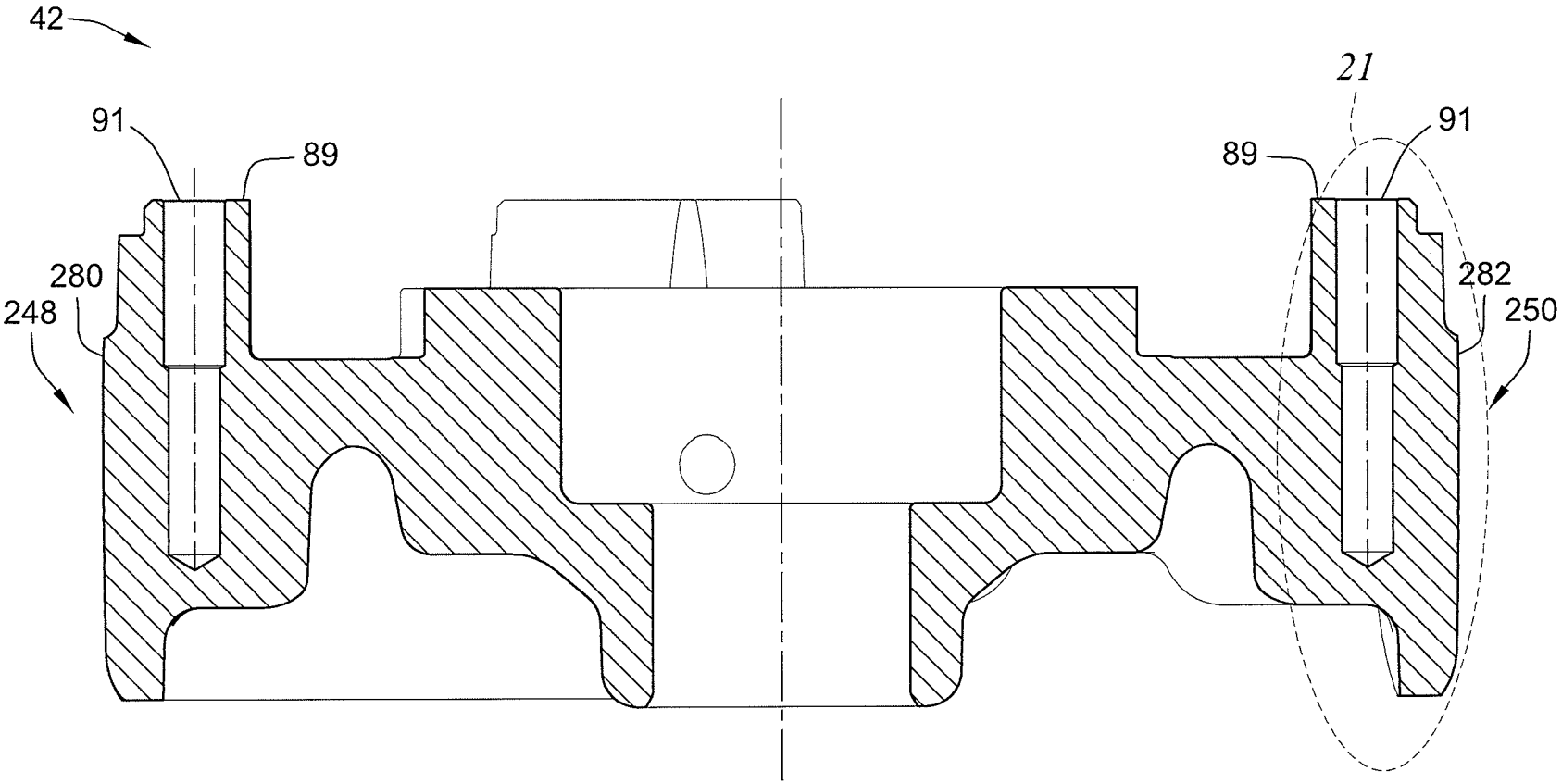
FIG. 20 is a cross-sectional view of the crankcase of FIG. 18.
Figure 22:
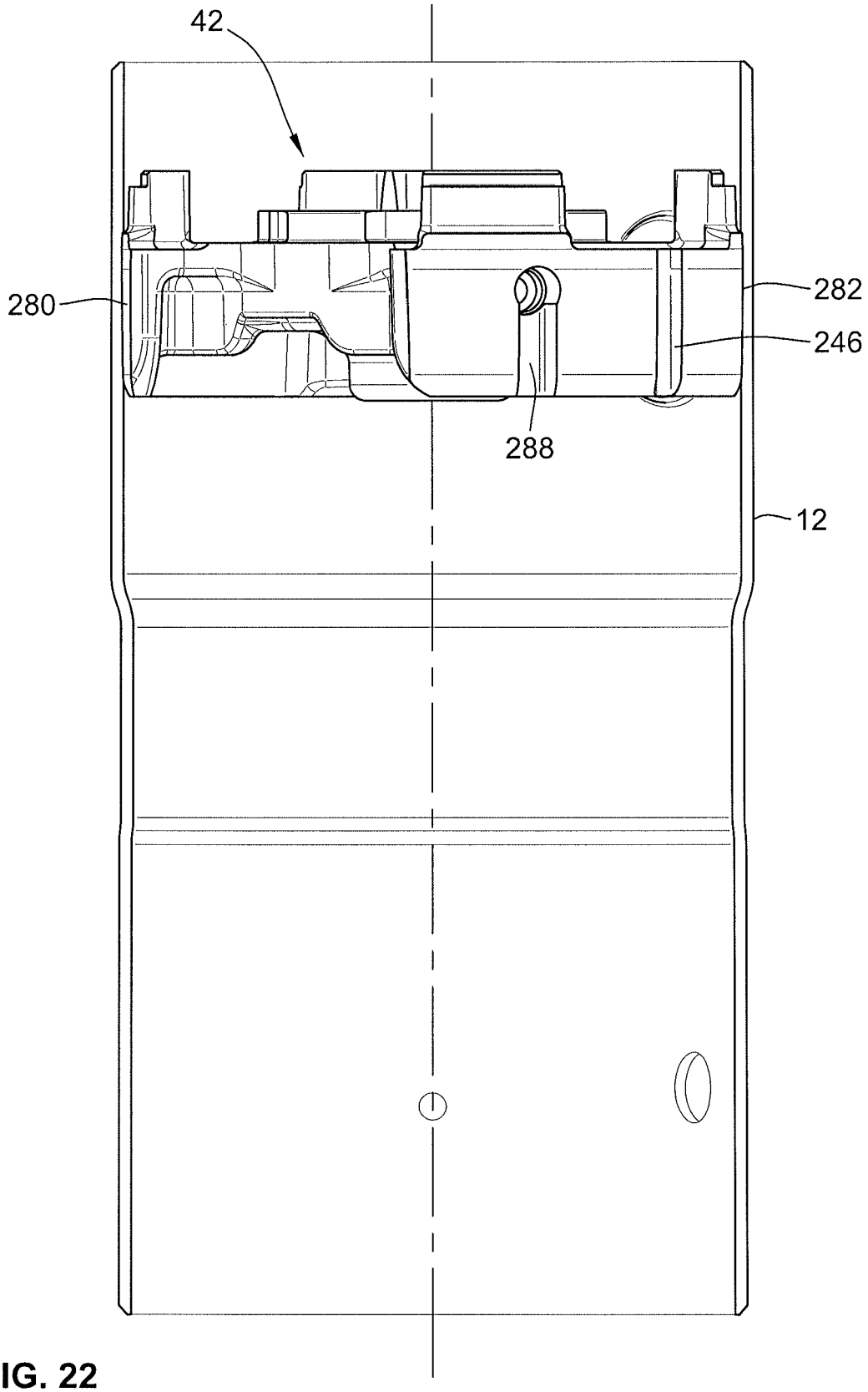
FIG. 22 is an isometric view of the crankcase of FIG. 18 in a shell, according to an embodiment of the invention.

FIG. 20 illustrates a cross section through two adjacent posts 89 and openings 91. In certain embodiments, crankcase 42 is press fit into housing 12. To facilitate press fitting, the contact regions 280 and 282 will define an axially extending surface with multiple radii of curvature. During the press fitting process, the contact regions 280 and 282 will engage the inner surface of shell 12 such that the shell 12 is deformed to generally meet the shape of the contact regions 280 and 282. This creates a contact force that maintains vertical position of the crankcase 42 within the shell 12, as illustrated in FIG. 22.

Figure 21:
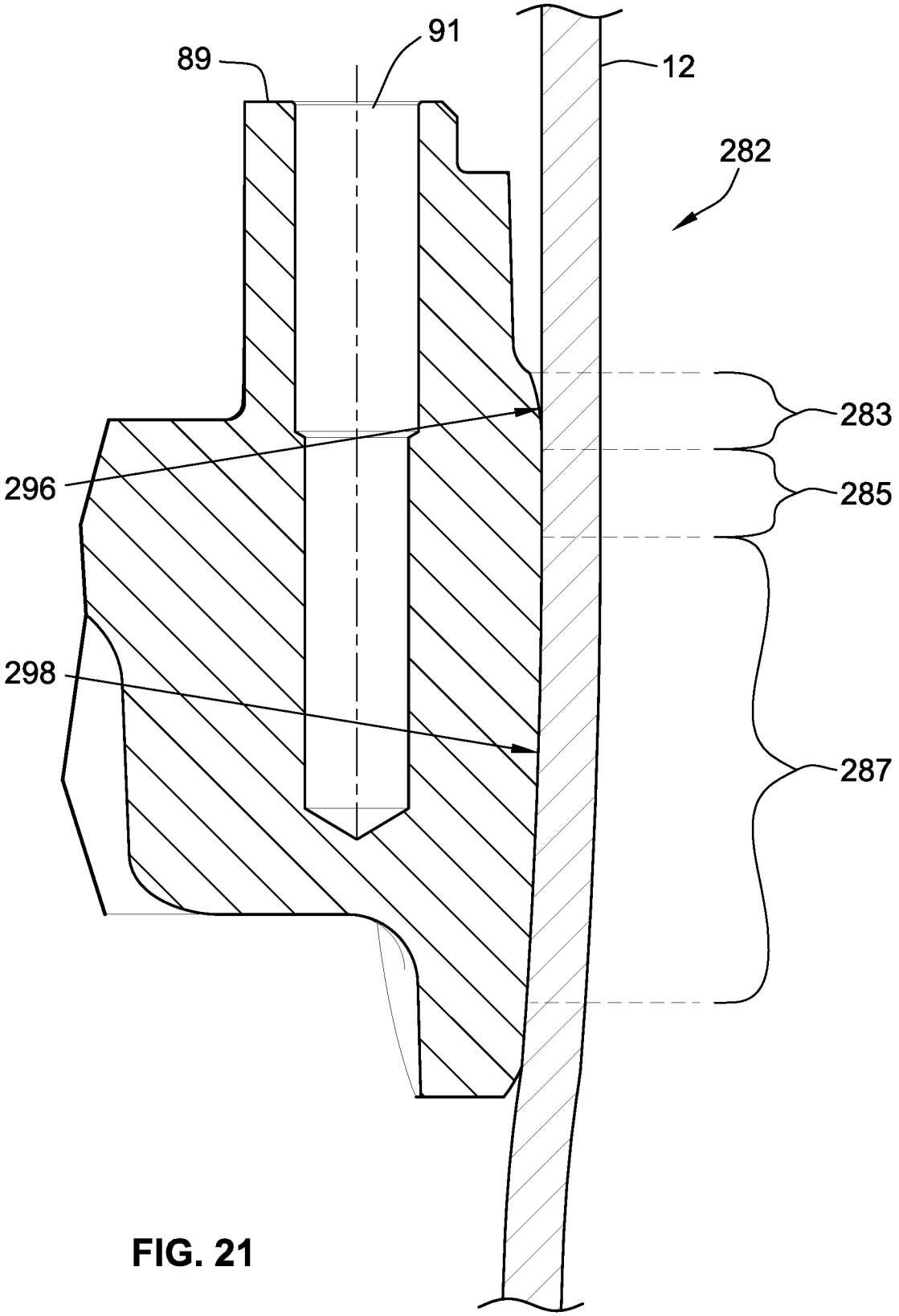
FIG. 21 is an up-close cross-sectional view of the profile of a cylinder section of the crankcase of FIG. 18.

FIG. 21 illustrates an up close profile of contact region 282 in contact with an inner surface of shell 12. Contact region 280 is not illustrated, but those skilled in the art will recognize that the contact between contact region 280 and the shell 12 is similar to that of contact region 282 and the shell 12, as illustrated. Therefore, the subsequent discussion is applicable to contact region 280 as well.

In the embodiment of the crankcase 42 illustrated in FIG. 21, contact region 282 includes a first section 283, a second section 285, and a third section 287, which forms a tapered diameter of contact region 282. The first section 283 is a curved surface with a first radius of curvature 296 typically ranging from 88 to 99 millimeters. The second section 285 is a flat surface, and the third section 287 is a curved surface with a second radius of curvature 298 typically ranging from 1561 to 2268 millimeters. As the crankcase 42 is press fit into the housing 12 (see FIG. 22), the housing 12 deforms to adhere to the profile of contact region 282 and 280 formed by the three sections 283, 285, and 287. By deforming the shell 12 to adhere to a profile of contact surfaces 280 and 282, the crankcase 42 is held in position within the shell 12 while maintaining a flat level surface for the axial thrust surface 96 and the posts 89. In a further embodiment, sections 283, 285, and 287 are straight tapered sections, or form a parabolic curve, or any structure such that includes a radius that varies over a range of axial positions.

Further, by having a curved surface as described above regarding the contact regions 280 and 282 unwanted misalignment of the crankcase 42 and deformation of the crankcase 42 are limited. Misalignment is limited because the curvature defined by the first, second, and third sections 283, 285, and 287 creates a relatively smooth transition between each section that does not have flat edges that could potentially catch on a portion of the housing 12 during press fitting.

Further, by having a curved surface as described above regarding the contact regions 280 and 282, deformation of the crankcase 42 is limited. Deformation of the crankcase 42 is limited because the profile of the contact regions 280 and 282 is a smooth surface, which limits any obstructions during the press fitting process. A periphery of the cylinder sections 248 and 250 defined by the third section 287 curvature is less than an inner periphery of the shell 12. As the crankcase 42 is press fit into the housing 12, an upper portion of the third section 287 will deform the housing 12 greater than a lower portion of the third section 287. As the third section 287 pushes into shell 12, the second section 285 comes into contact with the inner surface shell 12 and causes the shell 12 to deform around it uniformly because the second section 285 is flat. As the second section 285 pushes into the shell 12, the first section 283 makes contact with the inner surface of the shell 12. Further, the transition between the first, second, and third sections 283, 285, and 287 is smooth. Therefore, the curvature of the contact regions, as described above, limits impediments as the crankcase 42 is press fit into the shell 12 thereby limiting damage to the crankcase 42 during the press fit process.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of providing for a scroll compressor, comprising:

compressing fluid with a pair of scroll compressor bodies;

driving the scroll compressor bodies relative to each other with an electrical motor, the electrical motor having a stator and a rotor providing rotational output on a drive shaft, the drive shaft adapted to act on one of the scroll compressor bodies;

press fitting a bearing member into a housing, the bearing member having at least two cylinder sections being angularly spaced apart, and separated by at least two corresponding gaps such that the bearing member has intermittent contact with the housing;

rotationally supporting the drive shaft with the bearing member for rotation about an axis;

wherein the press fitting of the bearing member into the housing comprises press fitting the bearing member such that each cylinder section comprises a contact region including a first section with a first radius of curvature, a second section extending from the first section, the second section being flat, and a third section extending from the second section and having a second radius of curvature, and wherein, during the press fitting, the third section is the first section into the housing such that the housing deforms around the third section; and wherein the housing remains in contact with the entire second and third sections after the press fitting.

2. The method of claim 1, wherein any two adjacent cylinder sections are separated by one of the at least two gaps; and wherein an inner radius of the housing is smaller, at each of the at least two gaps, than the inner radius at each of the at least two cylinder sections after the press fitting.

3. The method of claim 1, wherein each of the at least two cylinder sections spans an angle that is greater than 50 degrees and less than 150 degrees.

4. The method of claim 1, wherein each cylinder section comprises an outer cylindrical surface spanning an angle greater than 50 degrees and less than 150 degrees, and at least one lubrication drainage channel is formed in each cylinder section and extends vertically over the cylindrical surface from top to bottom so as to facilitate drainage.

5. The method of claim 1, wherein the first radius of curvature of the first section is between 88 and 99 millimeters.

6. The method of claim 1, wherein the second radius of curvature of the third section is between 1561 and 2268 millimeters.

7. The method of claim 1, wherein the bearing member comprises two cylinder sections on opposite sides of a bearing member hub, and two gaps on opposite sides of the bearing member hub, the two gaps each extending between the two cylinder sections.

8. The method of claim 1, further comprising connecting a pilot ring to the bearing member with one or more mechanical fasteners, such that the pilot ring is in sliding contact with one of the scroll compressor bodies.

9. The method of claim 1, wherein the bearing member is an upper bearing member situated above the electrical motor, the upper bearing member comprising a plurality of posts projecting upwardly for supporting directly or indirectly one of the scroll compressor bodies, wherein each cylinder section connects at least two adjacent posts with each gap separating two adjacent posts.

10. The method of claim 1, wherein piloting one of the scroll compressor bodies with a pilot ring comprises, piloting one of the scroll compressor bodies with a pilot ring that surrounds at least one of the scroll compressor bodies, and has a cylindrical pilot interface therebetween.

11. The method of claim 1, wherein the press fitting of the bearing member into the housing causes the housing to also deform around the second section of the bearing member.

12. The method of claim 11, wherein the press fitting of the bearing member into the housing causes the housing to also deform around the first section of the bearing member.

13. The method of claim 1, wherein the press fitting of the bearing member into the housing comprises press fitting the bearing member with the third section having an axial length greater than the axial length of the first section and greater than the axial length of the second section.

14. The method of claim 1, wherein the press fitting of the bearing member into the housing comprises press fitting the bearing member where the second radius of curvature is more than seventeen and less than twenty-six times greater than the first radius of curvature.

15. The method of claim 1, wherein the first radius of curvature is different from the second radius of curvature.

16. The method of claim 1, wherein the radius of curvature of the third section is such that a first portion of the third section deforms the housing more than a second portion of the third section.

17. The method of claim 1, wherein the housing remains in contact with a portion of the first section after press fitting.

* * * * *